US009664015B2

(12) United States Patent
Hofman et al.

(10) Patent No.: US 9,664,015 B2
(45) Date of Patent: May 30, 2017

(54) FRACTURING SYSTEM AND METHOD

(71) Applicant: Peak Completion Technologies, Inc., Midland, TX (US)

(72) Inventors: Raymond Hofman, Midland, TX (US); William Sloane Muscroft, Midland, TX (US); Stephen Jackson, Eureka Springs, AR (US); Daniel J Rojas, Cypress, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 536 days.

(21) Appl. No.: 14/211,172

(22) Filed: Mar. 14, 2014

(65) Prior Publication Data

US 2014/0246207 A1 Sep. 4, 2014

Related U.S. Application Data

(63) Continuation-in-part of application No. 14/034,072, filed on Sep. 23, 2013, now abandoned, which is a continuation of application No. 12/909,446, filed on Oct. 21, 2010, now Pat. No. 8,540,019, application No. 14/211,172, which is a continuation-in-part of application No. 13/423,154, filed on Mar. 16, 2012, now Pat. No. 9,121,248, application No. 14/211,172, which is a continuation-in-part of application No. 13/423,158, filed on Mar. 16, 2012, now abandoned, application No. 14/211,172, which is a continuation-in-part of application No. 13/448,284, filed on Apr. 16, 2012, now abandoned.

(60) Provisional application No. 61/852,232, filed on Mar. 15, 2013, provisional application No. 61/453,281, filed on Mar. 16, 2011, provisional application No. 61/475,333, filed on Apr. 14, 2011.

(51) Int. Cl.

| | |
|---|---|
| ***E21B 34/14*** | (2006.01) |
| ***E21B 43/12*** | (2006.01) |
| ***E21B 43/14*** | (2006.01) |
| ***E21B 43/26*** | (2006.01) |
| *E21B 34/00* | (2006.01) |

(52) U.S. Cl.

CPC ..... *E21B 43/12* (2013.01); *E21B 34/14* (2013.01); *E21B 43/14* (2013.01); *E21B 43/26* (2013.01); *E21B 2034/005* (2013.01)

(58) Field of Classification Search

CPC ..... E21B 34/14; E21B 2034/005

See application file for complete search history.

(56) References Cited

U.S. PATENT DOCUMENTS

2012/0085548 A1* 4/2012 Fleckenstein ..... E21B 34/063 166/373

* cited by examiner

*Primary Examiner* — Robert E Fuller

(57) ABSTRACT

A system and method comprising at least one ported sleeve assembly and a flapper assembly positioned downwell of the ported sleeve assembly. The system provides for the use of multiple ported sleeve assemblies for each stage of a hydrocarbon producing well that can be opened with a single element, and multiple stages, each have thFracturinge ability to be opened with a single element size.

13 Claims, 20 Drawing Sheets

FRACTURING SYSTEM AND METHOD

CROSS-REFERENCES TO RELATED APPLICATIONS

This application is a continuation-in-part of U.S. patent application Ser. No. 14/034,072, which is a Continuation of U.S. patent application Ser. No. 12/909,446 filed Oct. 21, 2010, issued as U.S. Pat. No. 8,540,019 entitled "Fracturing System and Method"; a continuation-in-part of U.S. patent application Ser. No. 13/423,154 filed Mar. 16, 2012 and entitled "Downhole System and Apparatus Incorporating Valve Assembly With Resilient Deformable Engaging Element," which claims the benefit of U.S. Patent Application Ser. No. 61/453,281 filed on Mar. 16, 2011; is a continuation-in-part of U.S. patent application Ser. No. 13/423,158 filed Mar. 16, 2012 and entitled "Multi-stage Production System Incorporating Valve Assembly with Collapsible or Expandable Split Ring", which claims the benefit of U.S. Patent Application No. 61/453,288 filed Mar. 16, 2011 and entitled Valve Assembly and System for Producing Hydrocarbons; and is a continuation-in-part of U.S. patent application Ser. No. 13/448,284 filed on Apr. 16, 2012 and entitled "Assembly for Actuating a Downhole Tool, which claims the benefit Each of the above applications is incorporated herein by reference in their entirety as if fully set forth.

STATEMENT REGARDING FEDERALLY SPONSORED RESEARCH OR DEVELOPMENT

Not applicable.

BACKGROUND

1. Field of the Disclosure

The present disclosure relates to oil and natural gas production. More specifically, the invention is a system and method for fracturing one or more stages of a hydrocarbon-producing well.

2. Description of Related Art

In hydrocarbon wells, fracturing (or "fracing") is a technique used by well operators to create and extend fractures from the wellbore into the surrounding formation, thus increasing the surface area for formation fluids to flow into the well. Fracing is typically accomplished by either injecting fluids into the formation at high pressure (hydraulic fracturing) or injecting fluids laced with round granular material (proppant fracturing) into the formation. In either case, the fluids are pumped into the tubing string and into the formation though ports disposed in downhole tools, such as fracing valves.

Fracing multiple-stage production wells requires selective actuation of these downhole tools to control fluid flow from the tubing string to the formation. For example, U.S. Published Application No. 2008/0302538, entitled Cemented Open Hole Selective Fracing System, describes one such system for selectively actuating a fracing sleeve using a shifting tool. The tool is run into the tubing string and engages with a profile within the interior of the valve. An inner sleeve may then be moved to an open position to allow fracing or to a closed position to prevent fluid flow to or from the formation.

The most common type of multiple stage fracturing system is the "plug-and seat"-type system. Plug-and-seat systems are simpler actuating mechanisms than shifting tools and do not require running such tools thousands of feet into the tubing string. Most plug-and-seat systems allow a one-quarter inch difference between sleeves and the inner diameters of the seats of the valves within the string. For example, in a 4.5-inch liner, it would be common to drop plugs, such as balls, from 1.25 inches in diameter to 3.5-inches in diameter in one-quarter inch or one-eighth inch increments, with the smallest plug seat positioned in the last valve in the tubing string.

Although plug-and-seat systems are commercially well-established, such systems have inherent drawbacks. While this methodology provides for a quick and relatively cheap solution (in terms of component cost) to open a sleeve such as a fracing sleeve, the operator is saddled with inner dimension (ID) restrictions because the plug sizes start out small and progressively work upwell to the largest size. This limits the number of valves that can be used in a given tubing string because each plug would only be able to actuate a single valve, and the size of the liner only provides for a set number of valves with differently-sized plug seats. In other words, because a plug must be larger than the plug seat of the valve to be actuated so that it can engage its corresponding seat, and each ball must also be smaller than the ball seats of all upwell valves so it can pass through them as it travels through the tubing string to its corresponding seat, each ball can only actuate one tool.

Further, conventional ball-and-seat systems limit the flow rate of the fracing material within the tubing string. Operators want to maximize pump rates through the fracing system to treat the wellbore in the most efficient manner and get the most extension of fluids and fracing materials into the formation, which thereby increases production. But despite the large number of stages currently desired-modem multiple-stage wells typically run upwards of twenty-four stages-and working in the casing and open hole design sizes, there is only so much cross sectional area to work with.

The smaller balls and corresponding seats in these large systems are required to hold high pressure-usually ten thousand or more psi-which places design constraints on the engagement or contact area with current materials to ensure the ball does not crack, break, or extrude through the ball seat. Finding a ball material and preferred size that allows for the maximum amount of stages and uses the smallest engagement clearance possible requires use of stronger ball materials and affects impact reliability and the ability to drill out the balls following fracing.

Once all these parameters are allowed for, the smallest ball seat size in most cases ends up being as small as one inch in diameter, which can potentially cause premature opening of the sleeve as a result of fracing fluid moving through the sleeve at high flow rates. In order to avoid erosion of the plug seat and to ensure that the friction and pressure drop of the fracing or other treating fluid does not prematurely open or shift the ball seat without a ball, operators may be forced to lower their pump rates through the smaller seats at the lower end of the well.

Producers also want to minimize, or altogether eliminate, ID restrictions in order to alleviate and simplify any remedial work that might be required to allow production of hydrocarbons from the well. To achieve this with ball-and-seat systems, operators are forced to drill out the plug seats, such as ball seats, after fracing or other treatment, a procedure which is costly and time consuming. Moreover, this methodology presents a number of secondary issues, such as the inherent difficulty of working on a "charged" wellbore after fracing, wearing out mills and having to continuously trip the assembly out of the hole due to the number of sleeves to drill out, having to deal with sand, and the mechanical risk of a tool getting stuck in the hole with the drill out pipe or coil tubing, just to name a few. Such difficulties can further increase costs from tens of thousands to hundreds of thousands of dollars.

Systems in which only one seat is actuated by a given ball size are unable to duplicate the "cemented plug and perf"-type completions that have multiple stages per well and in which a well operator perforates multiple clusters of holes for each stage. Operators desire and have proven the effectiveness of this method in that it allows for multiple fluid exit points for each stage and multiple fluid production points, which is important in order to fully and effectively fracture the formation for each stage. As the formation is treated through a single fluid exit point, the rock may break down a significant distance down the wellbore, forcing the fluid to exit the casing and turn the corner in the annulus. This causes near wellbore tortuosity, which in some cases causes premature screen out. It also increases erosion possibilities and problematic friction pressures.

Although some systems are under development to allow for a single ball or other plug of each size to open multiple injection points, such systems still rely on using different size plugs for each stage of the treatment and have design concerns inherent to their approach. Furthermore, current "cemented plug and perf"-type completions utilize pump down composite or similar material plugs, which are set between the zones to stop fluid from fracing or otherwise flowing into the previous stage. This is costly both in resources and time because it requires the operator to stop fracing during the plug-setting operation, resulting in standby charges for the fracing and/or other treating equipment and increasing completion time from hours to days, or even weeks. This increases the overall cost exponentially without even considering the lost production that could have been made in that time period as well.

BRIEF SUMMARY

The present disclosure addresses these and other problems associated with the ball-and-seat type fracing systems described supra. The embodiments described herein include a system comprised of at least one ported sleeve assembly, but provides for the use of multiple ported sleeve assemblies for each stage that can be opened with a single plug, such as a wiper ball, extrudable plug, or other plug, and multiple stages, each having the ability to be opened with a single plug size.

One embodiment of the system of the present disclosure includes a treating sleeve assembly comprising at least one ported sleeve assembly and a flapper assembly positioned downwell of the ported sleeve assembly. Each ported sleeve assembly comprises a ported housing having a plurality of ports disposed radially therethrough; a first sleeve at least partially within the ported housing and moveable between a first position and a second position, wherein in the first position the first sleeve is radially positioned between the plurality of ports and the flowpath. The first sleeve has an exterior surface, a first slot formed in the first exterior surface, and a first engagement surface having a first inner diameter. A first guiding member is fixed relative to the ported housing and positionable within the first slot. A first compression spring positioned between the upper end of the first sleeve and the ported housing, the first compression spring being under compression when the first sleeve is in the first position. The flapper assembly comprises a flapper seal; a flapper plate rotatable between an opened position and a closed position, wherein in the opened position fluid flow in the downwell direction through the flapper seal is at least substantially unimpeded, and wherein in the closed position the flapper plate is engaged against the flapper seal to at least substantially prevent fluid flow through the flapper seal in the downwell direction; a second sleeve moveable between a first position and a second position, wherein in the first position at least a portion of the second sleeve is radially positioned between the flapper plate and the flowpath, the second sleeve having a second exterior surface, a second slot formed in the second exterior surface, and a second engagement surface having a second inner diameter; a second guiding member fixed relative to the flapper seal and positionable within the second walking jay slot; and a second compression spring positioned between an upper end of the second sleeve and the flapper seal, the second compression spring being under compression when the second sleeve is in the second position.

Another embodiment of the present disclosure provides for a combination treating sleeve assembly in which the ported housing and flapper valve are both operated by the same plug seat assembly. At least one port in the ported housing is isolated from fluid flowing through the interior of the treating sleeve assembly by a port sleeve and the flapper member of the flapper valve is held in the open position by a flapper sleeve. Both the port sleeve and flapper sleeve are connected, either directly or indirectly, to the plug seat. When such a treating sleeve assembly is actuated by a pressure differential across the plug seat, such as may result from engagement of an appropriately selected plug, the plug seat shifts from a first position to a second position at which the port sleeve no longer isolates the port or ports in the ported housing from fluid flowing through the interior of the treating sleeve assembly. The plug seat also shifts to a third position in which the flapper sleeve no longer holds the flapper member in the open and allows the flapper valve to prevent fluid flow in a desired direction, typically the downwell direction. In certain embodiments, the flapper sleeve and the port sleeve may be connected by a locking ring or similar member configured to disconnect the flapper sleeve and port sleeve when the plug seat reaches the second position. It will be appreciated that such a configuration allows flexibility in the positioning of the flapper valve in relation to the ports in the ported housing because the plug seat only has to shift the port sleeve far enough to open the ports, and not all the way beyond the flapper valve.

The combination treating sleeve assembly may be connected to a guide assembly comprising an indexing element, such as a walking J assembly. In such embodiment, an appropriately selected plug engages the plug seat and advances the indexing element. In such an embodiment, only when the indexing element advances to a desired position or value, such as when a walking J assembly reaches its final slot, the plug seat shifts to an actuated position which opens the ports and closes the flapper valve.

The embodiments of the present disclosure further encompass any device, system, or method that creates a pressure differential within a treating sleeve assembly to shift or index the treating sleeve assembly and which are capable of allowing additional, downwell, treating sleeve assemblies to also be shifted or indexed without the use of an additional plug. Such embodiments include expandable plug seats such as described in U.S. patent application Ser. No. 12/702,169 entitled "Downhole Tool with Expandable Seat" and U.S. patent application Ser. No. 13/423,158, filed Mar. 16, 2012 and entitled "Multistage Production System Incorporating Downhole Tool With Collapsible or Expandable C-Ring,", or others; extrudable plug materials such as is described in U.S. patent application Ser. No. 13/423,154, filed Mar. 16, 2012 and entitled "Downhole System and Apparatus Incorporating Valve Assembly With Resilient Deformable Engaging Element,", as well as plugless treating sleeve assemblies such as described in U.S. patent application Ser. No. 13/462,810 entitled "Downhole tool," which is incorporated herein by reference in its entirety, and others. Further, the present disclosure encompasses multi seat plug seat assemblies in which a pressure differential caused by first plug (or selectively created across a plugless seat) activates the treating sleeve assembly for subsequent indexing and/or actuation by one or more plugs of different size, shape or composition or by using plugless seats.

DETAILED DESCRIPTION

When used with reference to the figures, unless otherwise specified, the terms "upwell," "above," "top," "upper," "downwell," "below," "bottom," "lower," and like terms are used relative to the direction of normal production through the tool and wellbore. Thus, normal production of hydrocarbons results in migration through the wellbore and production string from the downwell to upwell direction without regard to whether the tubing string is disposed in a vertical wellbore, a horizontal wellbore, or some combination of both. Similarly, during the fracing process, fracing fluids move from the surface in the downwell direction to the portion of the tubing string within the formation.

Figure 1:
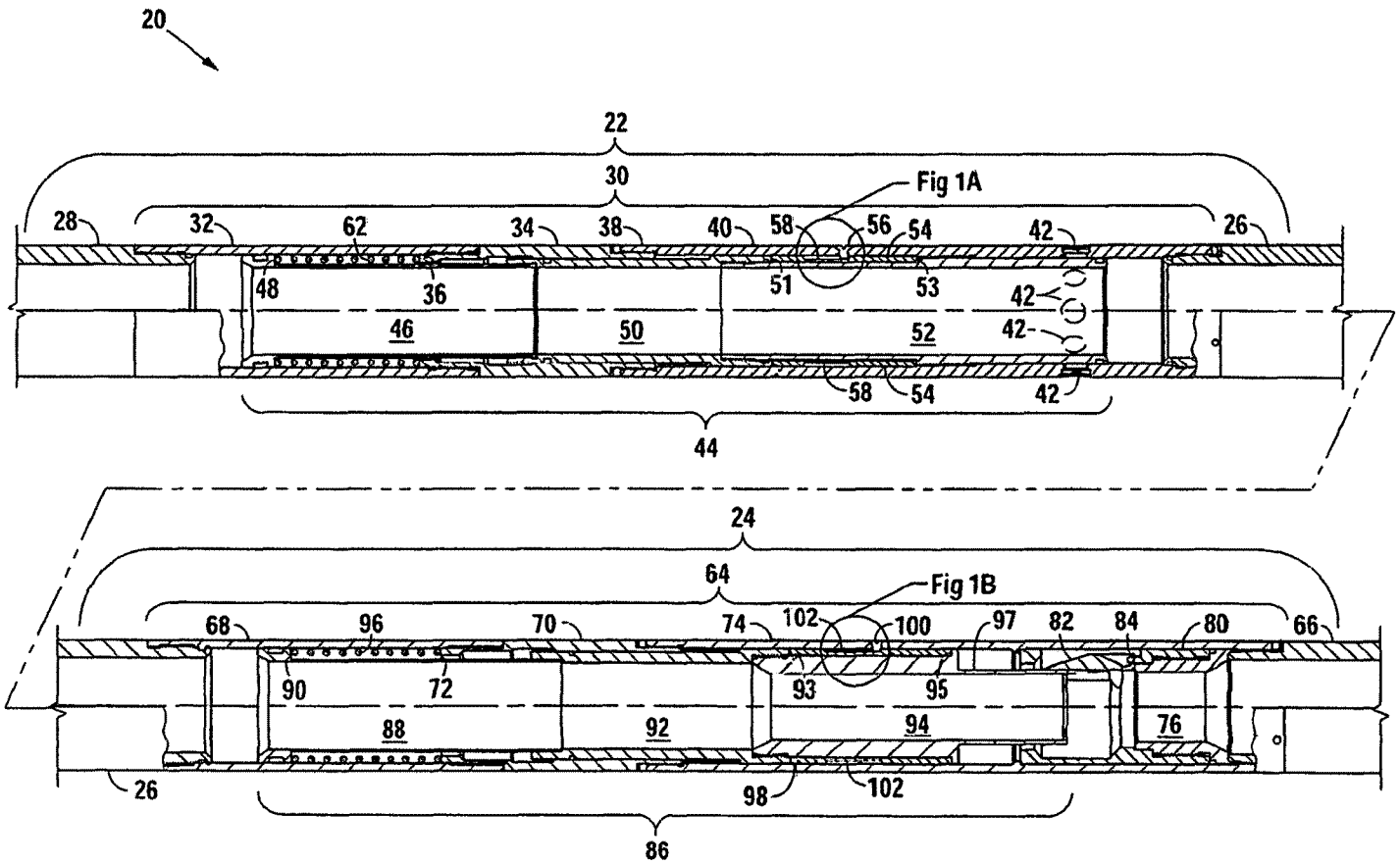
FIG. 1 is a sectional side elevation of a preferred embodiment of an apparatus of the present disclosure in a neutral state.

FIG. 1 depicts one embodiment 20 of the present disclosure, which comprises a normally-closed ported sleeve assembly 22 located upwell from an associated normally-open flapper assembly 24. A tubing string section 26 provides a fluid communication path between the ported sleeve assembly 22 and the flapper assembly 24.

The ported sleeve assembly 22 and the flapper assembly 24 each can transition between three states: (i) a neutral state, which is shown in FIG. 1; (ii) a "shifted" state, as shown in and described with reference to FIG. 4; and (iii) an "actuated" state, as shown in and described with reference to FIG. 5. When used with reference to a normally-closed ported sleeve assembly, "actuated" means that the ports are opened to allow radial flow. When used with reference to a normally-open flapper assembly, "actuated" means closed.

The ported sleeve assembly 22 comprises a top connection 28 threaded to a first housing assembly 30 that includes a spring housing 32, a seal housing 34 having an annular upper end 36, and a ported housing 40. A plurality of radially-aligned ports 42 is disposed through the ported housing 40 to provide a fluid communication path between the interior of the ported sleeve assembly 22 and the surrounding formation.

A first sleeve 44 is nested and is moveable longitudinally within the first housing assembly 30. The first sleeve 44 comprises a spring mandrel 46 having an annular shoulder 48 located at the upper end of the sleeve 44, and an upper seal mandrel 50 having an annular lower end 51. An upper compression spring 62 is positioned within an annular volume defined by the annular shoulder 48 and the annular upper end 36 of the seal housing 34. In the neutral position shown in FIG. 1, the compression spring 62 is under approximately three-hundred pounds of compression.

Figure 1A:
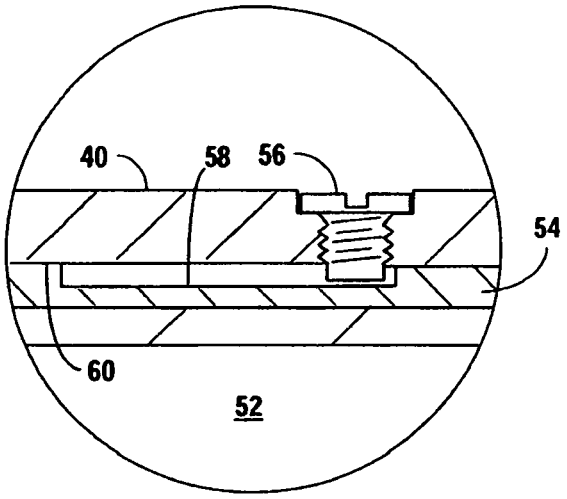
FIGS. 1A and 1B are enlarged views of portions of FIG. 1.

The first sleeve 44 further comprises a lower seal mandrel 52 having an annular middle shoulder 53, and an annular slotted member 54 positioned around the lower seal mandrel 52 and fixed longitudinally between the lower end 51 of the upper seal mandrel 50 and the middle shoulder 53. The slotted member 54 fits snugly around the lower seal mandrel 52, but is freely rotatable thereabout. The first sleeve 44 has an annular inner engagement surface 39 that will seal with an appropriately sized wiper ball, as will be described infra As shown in FIG. 1A, a guiding member, such as a torque pin 56, is fixed relative to, and extends through, the ported housing 40. The torque pin 56 is positioned within a walking jay slot 58 formed in the exterior surface 60 of the slotted member 54.

Figure 2A:
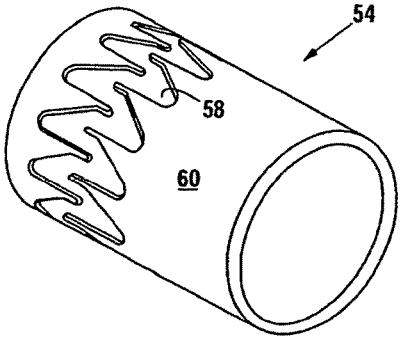
FIGS. 2A and 2B are isometric front and rear views of the upper slotted member shown in FIG. 1.
Figure 2B:
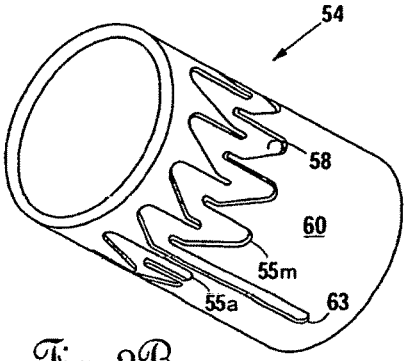
Figure 2C:
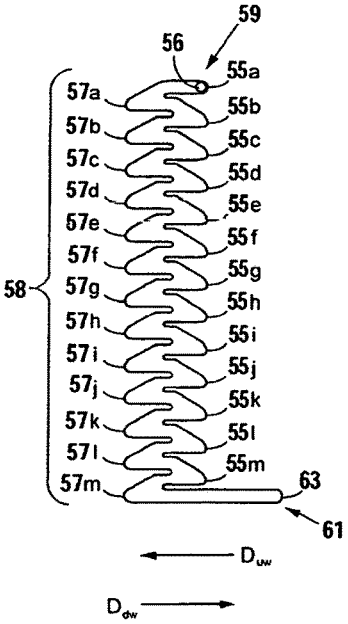
FIG. 2C shows the footprint of the slot formed in the exterior surface of the slotted member shown in FIGS. 2A and 2B.

FIGS. 2A-2C show the slotted member 54 and walking jay slot 58 in more detail. The walking jay slot 58 is a continuous path extending radially around and formed in the exterior surface 60 of the slotted member 54. The slot 58 is formed of a repeated pattern of thirteen neutral positions 55*a*-55*m* and thirteen shifted positions 57*a*-57*m*. A first end 59 of the slot 58 terminates in the first neutral position 55*a*. A second end 61 of the slot 58 terminates with an actuated position 63 positioned downwell of the neutral positions 55*a*-55*m*.

The slot 58 is shaped so that when the upper torque pin 56 is in a neutral position and the upper slotted member 54 moves downwell relative to the ported housing 40 (in direction $D_{dw}$), the upper torque pin 56 moves, relative to the slotted member 54, toward the adjacent shifted position. For example, when the torque pin 56 is in the first neutral position 55*a* and the slotted member 54 moves in direction $D_{dw}$, the torque pin 56 travels along the slot 58 to the first shifted position 57*a*, where further downwell movement of the slotted member 54 is impeded. When the upper torque pin 56 is in a shifted position, such as the first shifted position 57*a*, and the slotted member 54 moves upwell in direction $D_{dw}$, the upper torque pin 56 travels toward the next adjacent neutral position, which is the second neutral position 55*b*, or, if the torque pin 56 is at the thirteenth shifted position 57*m*, to the actuated position 63 as shown in FIG. 2C.

Referring again to FIG. 1, a second housing assembly 64 is connected to the tubing string section 26 and a bottom connection 66. The second housing assembly 64 comprises a spring housing 68, a seal housing 70 having an annular upper end 72, and a lower housing 74.

A flapper seal 76 is nested within the lower housing 74 and is adjacent to and upwell of the bottom connection 66. The flapper seal 76 is connected to a flapper mount 80. A flapper plate 82 is rotatably attached to the flapper mount 80 and rotatable about a pivot pin 84 between an opened position and a closed position. In the opened position, the flowpath within the second housing assembly 64 is unobstructed by the flapper plate 82. In the closed position, the flapper plate 82 engages the flapper seal 80 to prevent downwell flow, but allows fluid to pass the flapper plate 82 in the upwell direction.

A second sleeve 86 is nested, and is longitudinally moveable, within the second housing assembly 64. The second sleeve 86 comprises a spring mandrel 88 having an annular upper shoulder 90 positioned at the upper end of the second sleeve 86, an upper seal mandrel 92 having an annular lower end 93, and a lower seal mandrel 94 having an annular middle shoulder 95. A compression spring 96 is positioned between the annular upper shoulder 90 of the spring mandrel 88 and the upper end 72 of the seal housing 70. In the neutral position shown in FIG. 1, the lower compression spring 96 is under approximately three hundred pounds of compression. The second sleeve 86 has an annular inner engagement surface 87 that will seal with an appropriately sized wiper ball. The engagement surfaces 39, 87 are sized and shaped to seal with the same wiper ball.

Figure 1B:
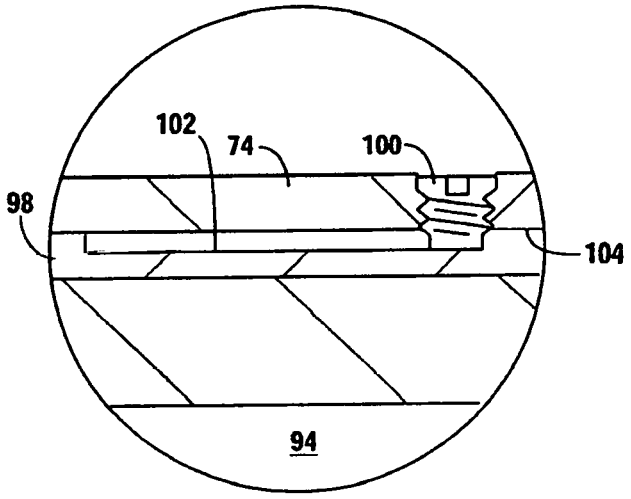

A slotted member 98 fits snugly around the lower seal mandrel 94, but is freely rotatable thereabout The slotted member 98 is positioned and longitudinally fixed between the lower end 93 of the upper seal mandrel 92 and the middle shoulder 95 of the lower seal mandrel 94. A lower portion 97 of the lower mandrel 94 has an outer diameter smaller relative to the remainder of the sleeve 86, which lower portion 97 is sized to fit into an upper opening of the flapper seal 82 and support the flapper plate 82 in an opened position. A lower guiding member, such as a torque pin 100, is fixed relative to, and extends through, the lower ported housing 74, and is engaged with a lower walking jay slot 102 formed in the exterior surface 104 of the slotted member 98, as also shown in FIG. 1B.

Figure 3A:
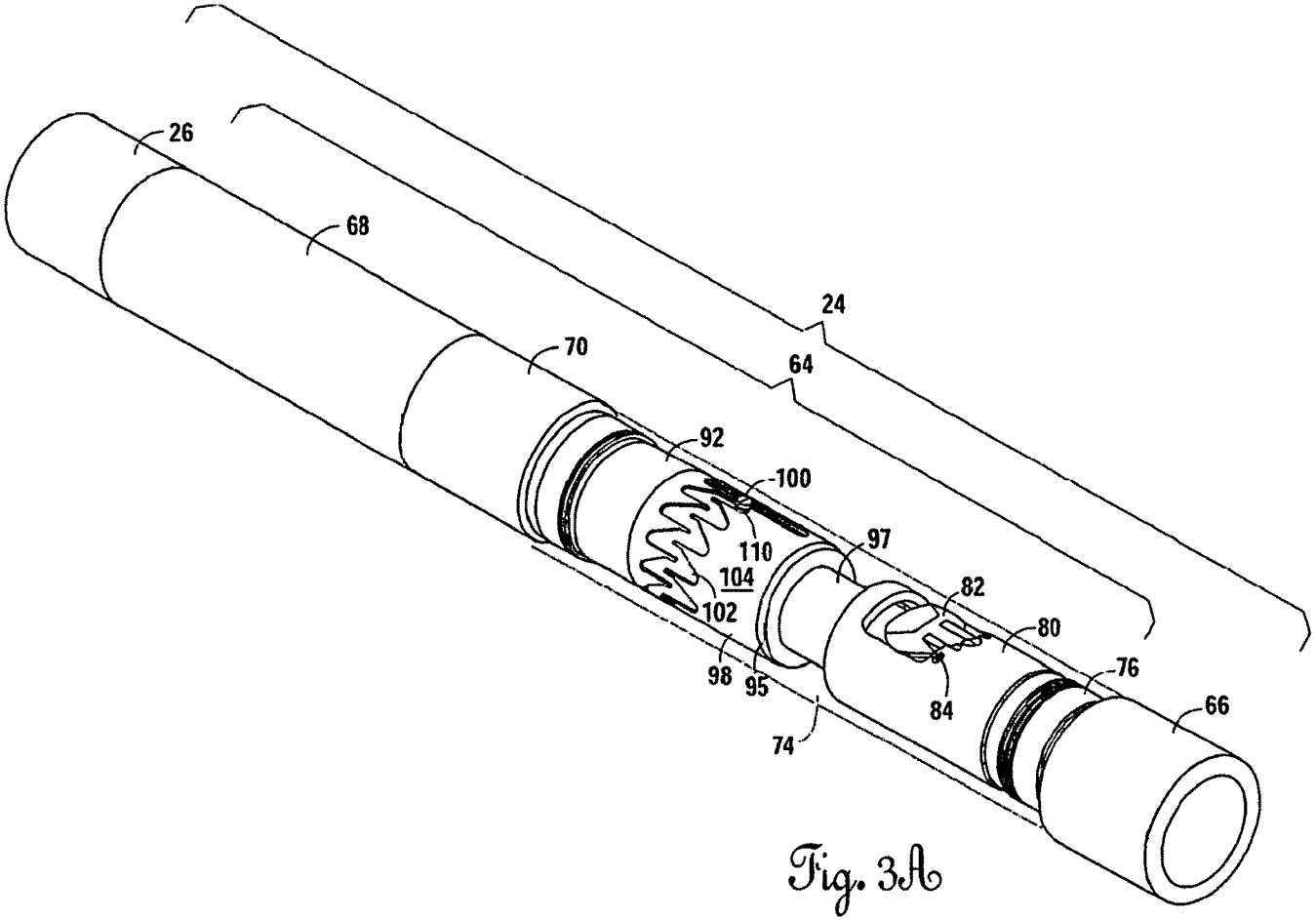
FIG. 3A is an isometric view of the flapper assembly shown in FIG. 1.

FIG. 3A is a perspective view of the flapper assembly 24 shown in FIG. 1. The flapper seal 76 is threaded to a flapper mount 80. The flapper plate 82 is rotatably attached to the flapper mount 80 and rotatable about a pivot pin 84 between an opened position and a closed position. In the opened position shown in FIG. 3A, the flowpath is unobstructed by the flapper plate 82. In the closed position, the flapper plate 82 engages the flapper seal 76 to prevent downwell flow.

Figure 3B:
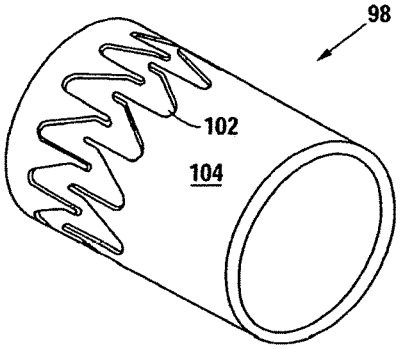
FIGS. 3B and 3C are isometric from and rear views of the lower slotted member shown in FIG. 3A.
Figure 3C:
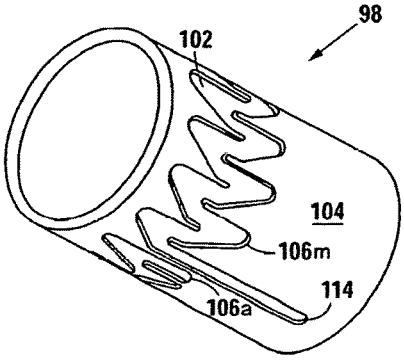
Figure 3D:
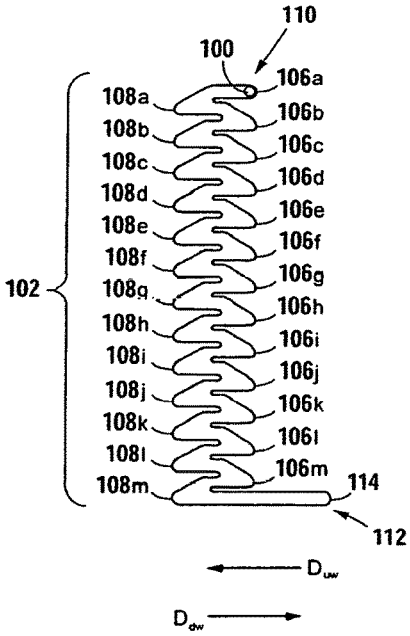
FIG. 3D shows the footprint of the slot formed in the exterior surface of the slotted member shown in FIGS. 3B and 3C.

As shown in FIGS. 3B-3D, the second walking jay slot 102 is a continuous path extending radially around and formed in the exterior surface 104 of the second slotted member 98. The second slot 104 is formed of a repeated pattern of thirteen neutral positions 106*a*-106*m* and thirteen shifted positions 108*a*-108*m*. A first end 110 of the second slot 102 terminates in the first neutral position 106*a*. A second end 112 of the second slot 102 terminates with an actuated position 114 positioned downwell of the neutral positions 106*a*-106*m*.

The second slot 102 is shaped so that when the lower torque pin 100 is in a neutral position and the slotted member 98 moves downwell relative to the flapper housing in direction $D_{dw}$, the torque pin 100 moves toward the adjacent shifted position. For example, when the torque pin 100 is in the first neutral position 106*a* and the slotted member 98 moves in direction $D_{dw}$, the torque pin 100 moves along the slot 102 to the first shifted position 108*a*, where further downwell movement of the slotted member 98 is impeded. When the lower torque pin 100 is in a shifted position, such as the first shifted position 108*a*, and the slotted member 98 moves upwell in direction $D_{uw}$, the torque pin 100 moves toward the next adjacent neutral position, which is the second neutral position 106*b*, or, if the torque pin 100 is at the last shifted position 108*m*, to the actuated position 114.

Operation of the embodiment 20 is initially described with reference to FIG. 1. During installation, the embodiment 20 is positioned in a wellbore with the first torque pin 56 positioned at the first end 110 of the first slot 58 (see FIG. 2C), which is in the first neutral position 55*a*, and with the second torque pin 100 positioned at the first end 110 of the second slot 102, which is in the first neutral position 106*a*. In this neutral state, the first sleeve 44 is positioned radially between the plurality of ports 42 and the flowpath to prevent fluid flow to and from the surrounding formation. The lower portion 97 of the lower seal mandrel 94 is positioned adjacent to and is in contact with the flapper plate 82. In this state, the flapper plate 82 is urged rotationally downward toward the flapper seal 78 by a torsion spring (not shown), but the lower portion 97 of the lower seal mandrel 94 impedes rotation of the flapper plate 82 to a closed position.

Figure 4:
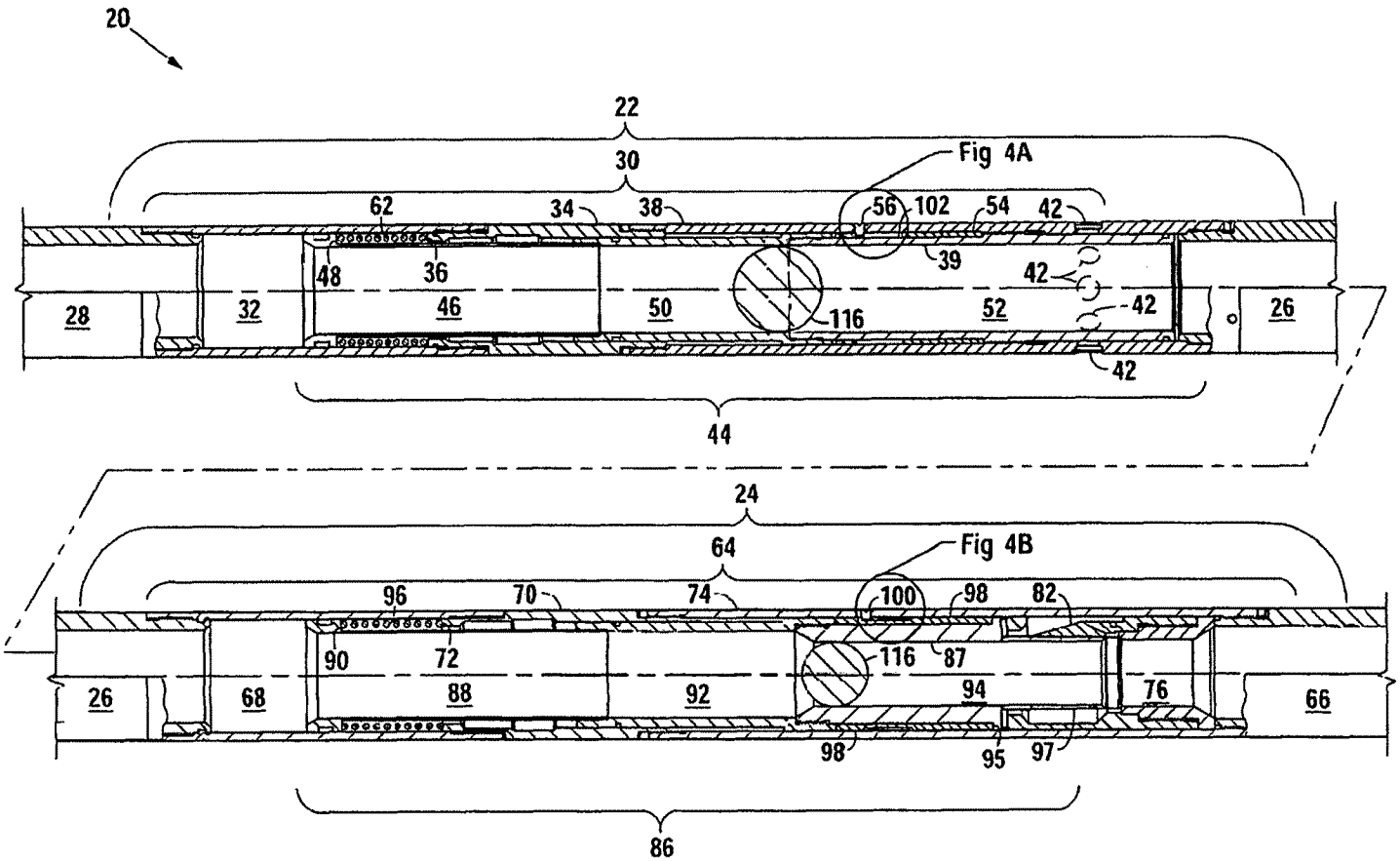
FIG. 4 is a side sectional elevation of the embodiment shown in FIG. 1 in a shifted state.
Figure 4A:
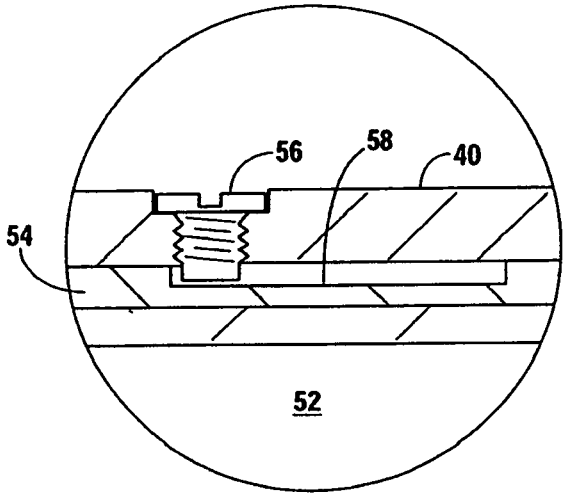
FIGS. 4A and 4B are enlarged views of portions of FIG. 4.
Figure 4B:
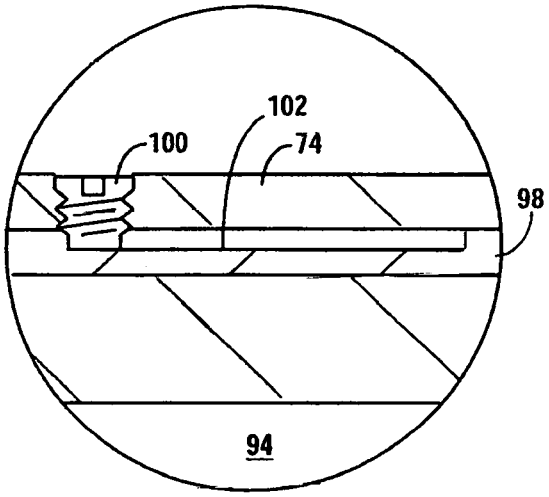

As shown in FIG. 4, to shift the embodiment 20, the well operator pumps a wiper ball 116 downwell to the embodiment 20. The wiper ball 116 is a rubber ball larger than the ID of the engagement surfaces 39, 87 of the first and second sleeves 44, 86. The wiper ball 116 seals to the engagement surface 39 of the first sleeve 44, thus creating a friction pressure against it. Although the expansive force of the compression spring 62 resists downwell movement of the first sleeve 44, when the pressure differential across the wiper ball 116 exceeds a first pressure differential, the expansive force of the compression spring 62 is overcome and the first sleeve 44 moves to the second position shown in FIG. 4, and the torque pin 56 moves to the next shifted position of the slotted member 54, depending on the position of the torque pin 56 within the slot 58 prior to shifting.

After the first sleeve 44 has shifted, the continued pressure differential will extrude the wiper ball 116 past the engagement surface 39 and through the first sleeve 44. The compression spring 62 will thereafter expand to return the first sleeve 44 to a neutral or the actuated position, depending on the position of the torque pin 56 within the slot 58 (see FIG. 2C).

The wiper ball 116 thereafter moves through the tubing string section 26 and seals against the engagement surface 87 of the second sleeve 86. When the pressure differential across the wiper ball 116 exceeds a second pressure differential, the expansive force of the compression spring 96 is overcome and the second sleeve 86 is shifted to the second position shown in FIG. 4 while the slotted member 98 is rotated to a shifted position relative to the torque pin 100, depending on the position of the torque pin 100 within the slot 102.

After the second sleeve 86 has shifted, the continued pressure differential will extrude the wiper ball 116 past the engagement surface 87 and through the second sleeve 86. The compression spring 96 will thereafter expand between the upper annular shoulder 90 and the seal housing 70 to return the second sleeve 86 to a neutral position or the actuated position, depending on the position of the torque pin 100 within the second slot 102 (see FIG. 3D).

As shown in FIG. 2C, the sequence described above is repeatable for the first sleeve 44 until the torque pin 56 reaches the thirteenth neutral position 55*m* of the upper slot 58*m*. Thereafter, the next wiper ball passing through the first sleeve 44 will cause the torque pin 56 to move to the thirteenth shifted position 57*m* of the first slot 58. After the wiper ball passes through the first sleeve 44 as described supra, the compression spring 62 will urge the spring return 46 upwell until the torque pin 56 moves to the actuated position 63.

As shown in FIG. 3D, the same wiper ball will then pass through the flapper assembly 24 and cause the second torque pin 100 to move to the thirteenth shifted position 108*m* of the slot 102. Thereafter, after the wiper ball passes through the second sleeve 86 as described supra, the compression spring 96 will urge the second sleeve 88 upwell until the torque pin 100 moves to the actuated position 114 of the slotted member 98.

Figure 5:
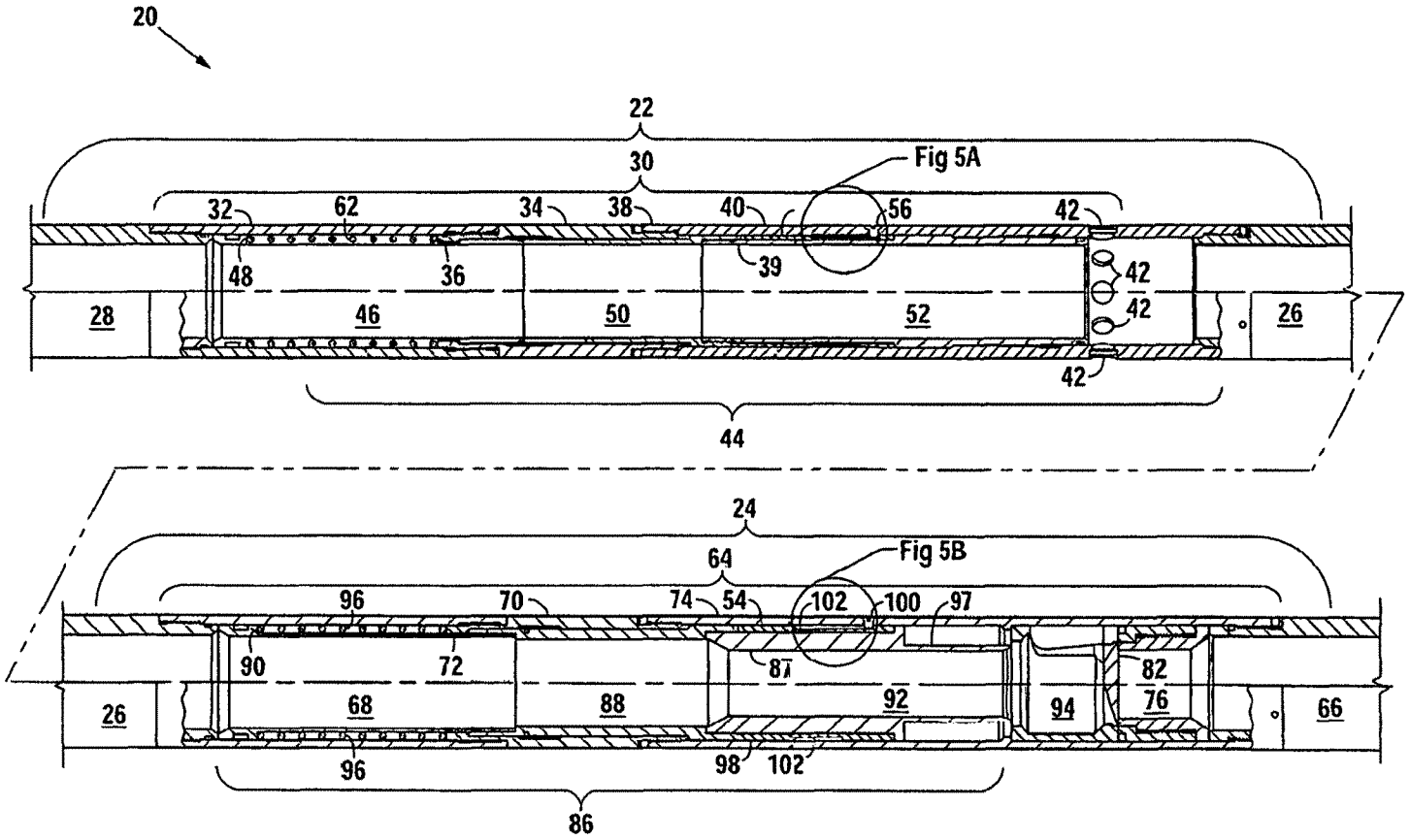
FIG. 5 is a side sectional elevation of the embodiment shown in FIG. 1 in an actuated state.
Figure 5A:
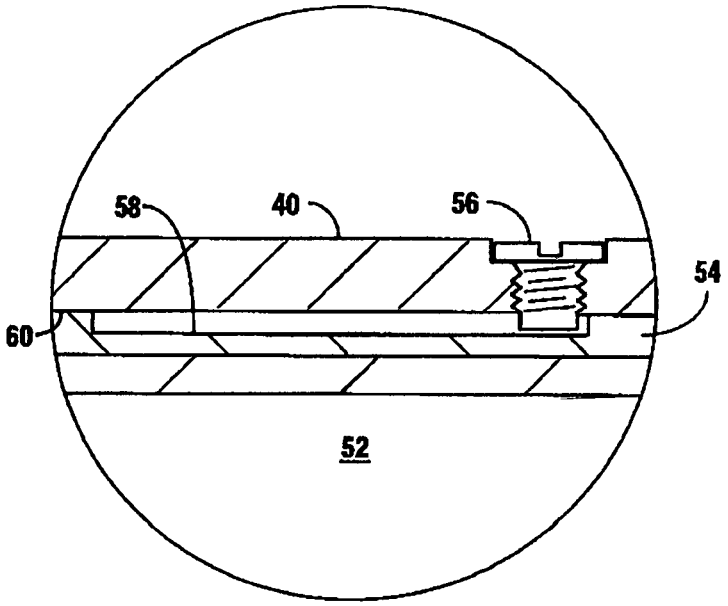
FIGS. 5A and 5B are enlarged views of portions of FIG. 5.
Figure 5B:
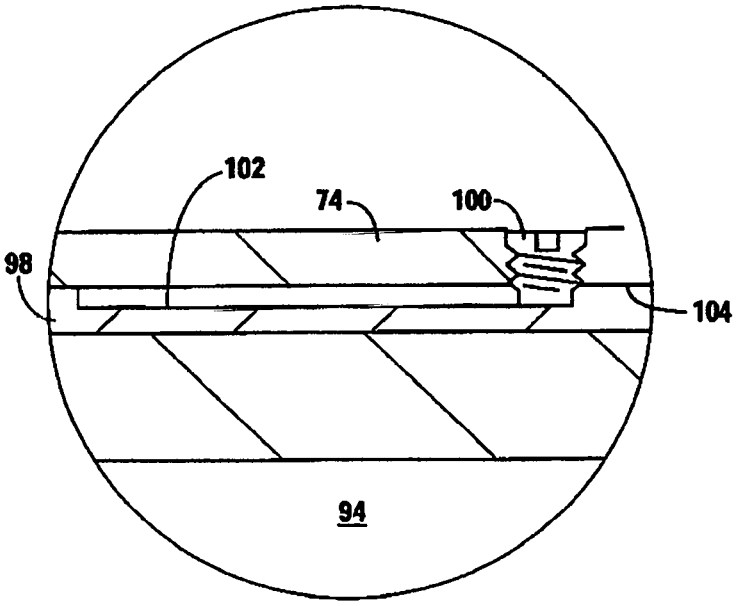

As shown in FIG. 5, when the first torque pin 58 is located in the actuated position 63 of the first slot 58, the first sleeve 44 is in a second position upwell of the plurality of ports 42, thereby permitting fluid flow into the surrounding formation from the flowpath. In this state, the compression spring 62 is under minimal, if any, compression.

Similarly, when the torque pin 100 is located in the actuated position 114 of the slotted member 98, the second sleeve 86 is in a second position located upwell of the flapper plate 82. Because in this position the lower portion 97 of the lower seal mandrel 92 does not support the flapper plate 82 in the opened position shown in FIG. 1. and FIG. 4, the flapper plate 82 rotates to the closed position, which blocks fluid flow through the flapper seal 76. The compression spring 96 is under minimal, if any, compression.

Although the embodiment 20 as described above requires thirteen cycles to actuate the first and second sleeves 44, 86 to their second positions if the torque pins 56, 100 are initially positioned at the first ends 59, 110 of the first and second slots 58, 102, the number of shifting cycles until actuation may be reduced by positioning the embodiment 20 in the wellbore with the torque pins 56, 100 positioned in one of the intermediate neutral slot positions 55*b*-55*m*, 106*b*-106*m*. For example, the embodiment 20 may be preset to require only four shifting cycles by setting the torque pins 58, 100 to the tenth neutral positions 55*j*, 106*j* prior to installation in the tubing string. Thus, passage of the fourth wiper ball will actuate the sleeve assemblies 44, 86 to the second positions shown in FIG. 5.

Figure 6:
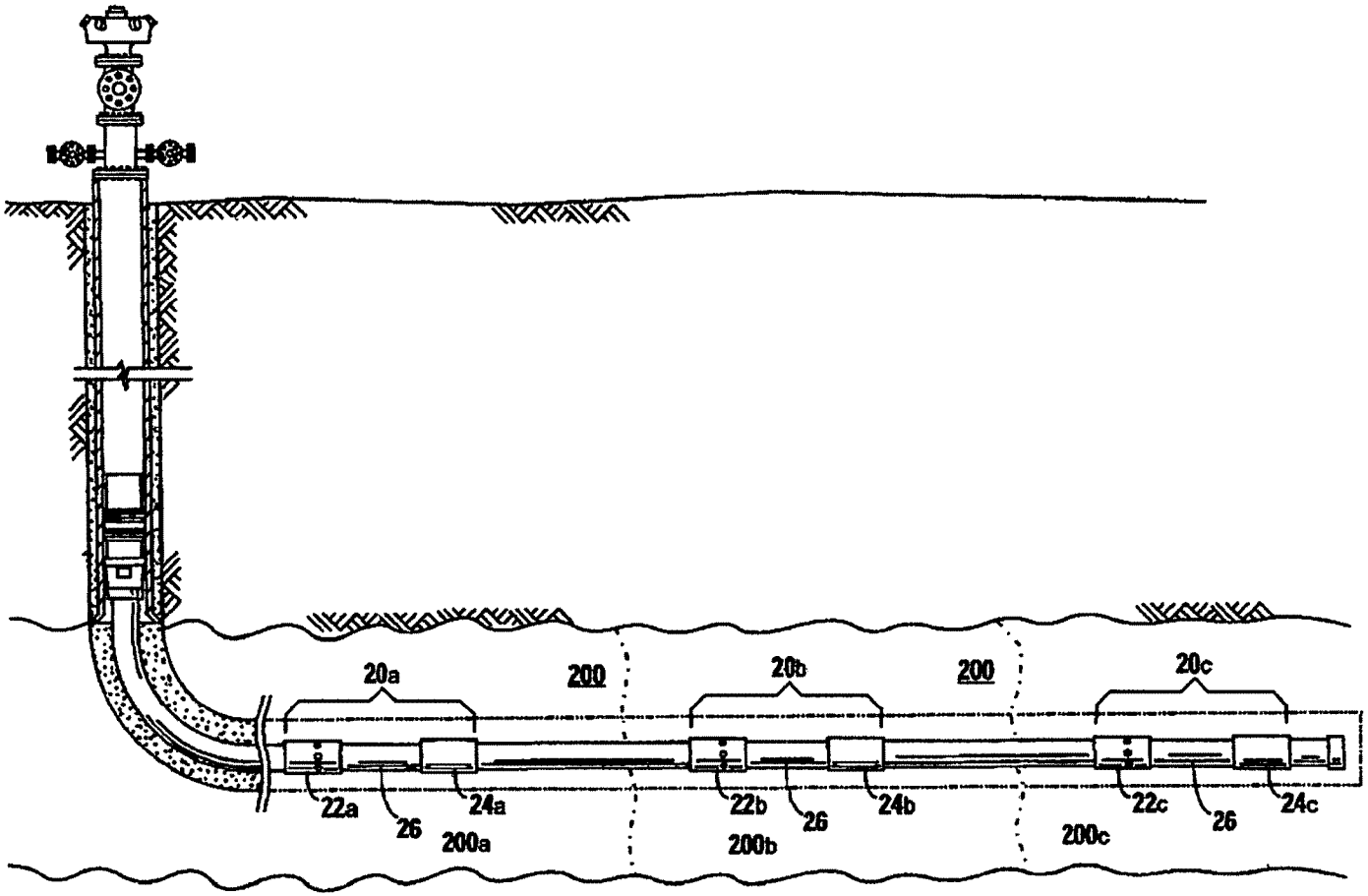
FIG. 6 is a side elevation of a system incorporating multiple tools of the preferred embodiment shown in FIG. 1.

FIG. 6 shows a system comprising three tools 20*a*-20*c* installed in a formation production well drilled in a hydrocarbon producing formation 200 that has three stages 200*a*-200*c*. Each of the tools 20*a*-20*c* comprises a ported sleeve assembly 22*a*-22*c* and a flapper assembly 24*a*-24*c* as described supra. Each of the tools 20*a*-20*c* is configured to require a different number of shifting cycles prior to actuating: the lower tool 20*c* is located in the lower stage 200*c* and is set to actuate after one shifting cycle (i.e., the guiding members are initially positioned in neutral positions 55*m* and 106*m* of FIGS. 2C and 3D, respectively); the middle tool 20*b* is located in the middle stage 200*b* and is set to actuate after two shifting cycles (i.e., the guiding members are initially positioned in neutral positions 551 and 1061); and the upper tool 20*a* is located in the upper stage 200*a* and is set to actuate after three shifting cycles (i.e., the guiding members are initially positioned in neutral positions 55*k* and 106*k*).

To fracture the surrounding formation 200, a first wiper ball is moved through the tubing string and tools 20*a*-20*c* as described supra. Because the lower tool 20*c* is set to only require one shifting cycle for actuation, the lower ported assembly 22*c* is opened to permit fluid flow into the surrounding formation 200, shortly after which the lower flapper assembly 24*c* is closed to prevent downwell flow. The area adjacent to the lowest tool 20*c* may thereafter be fracked by increasing and maintaining pressure against the closed flapper plate of the flapper assembly 20*c*.

When a second wiper ball is passed through the tubing string as described with reference to FIGS. 1-5, the middle ported assembly 22*b* is opened, shortly after which the middle flapper assembly 24*b* is closed. The area adjacent to the middle tool 20*b* may thereafter be fracked by increasing and maintaining pressure against the closed flapper plate of the middle flapper assembly 20*b*.

When a third wiper ball is passed through the tubing string as described with reference to FIGS. 1-5, the upper ported sleeve assembly 22*a* is opened and the upper flapper assembly 24*a* is closed. The area adjacent to the upper tool 20*a* may thereafter be fracked by increasing and maintaining pressure against the closed flapper plate of the upper flapper assembly 24*a*.

After fracturing, the well operator can produce hydrocarbons through the tools 20*a*-20*c* and downwell of the deepest tool 20*c* because the flapper assemblies 24*a*-24*c* allow fluid flow in the upwell direction without further manipulation by the operator. In alternative embodiments of the system, additional ported sleeve assemblies may be utilized within one or more stages 200*a*-200*c* to provide additional fracturing entry points into the surrounding formation 200.

One embodiment of the system of the present disclosure increases the maximum number of stages from twenty-four for typical ball-and-seat systems to twelve stages for each ball size, or two hundred eighty-eight stages, which is more than typically necessary for a producing well. In most embodiments, however, the operator uses only one or two different ball sizes that are as close to the maximum tubing string ID as possible in order to eliminate ID restrictions imposed by smaller seats. For example, a casing liner of 3.99 inches ID and a ball of 3.875 inches OD that mates to a sleeve of 3.75 inches ID, and having twelve stages of five sleeves per stage would allow for sixty ported sleeves to be treated sequentially. The 3.75 inch ID inches would not impose any significant flow restriction, thereby eliminating any need for drill out.

If the operator desires more than twelve independent stages, then a second ball size can be used. Such a design, for example, would allow for a 3.625 inch OD ball mated to a 3.5 inch ID sleeve for the second set of sleeves, which would also, in most cases, eliminate the need for any drill out by the operator because of flow restrictions. This configuration would allow up to one-hundred twenty ported sleeves to be treated sequentially in stages utilizing two different ball sizes with no need to shut down between stages, thus maximizing time and cost efficiency, eliminating the need for any drill out, eliminating any of the associated mechanical risk, reducing the potential for production loss during the operation and operational costs, and ensuring that all ported sleeves are treated without the risk of breaking a ball prematurely and needing to treating stages twice.

Figure 7:
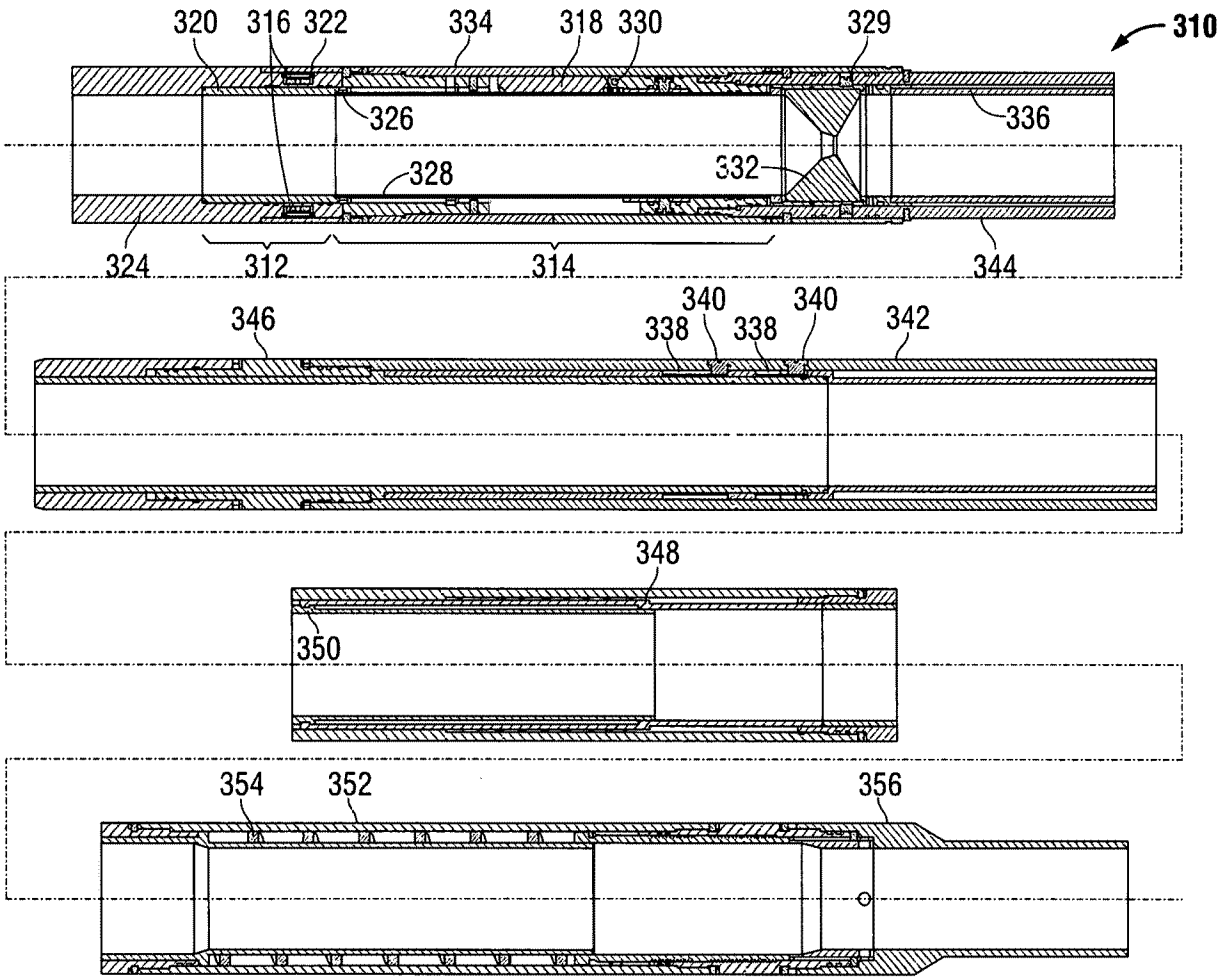
FIG. 7 is a sectional side elevation view of an embodiment of an apparatus of the present disclosure in a neutral state.

In yet another embodiment of a treating sleeve assembly, the treating port and the flapper valve may be operated by a single plug seat valve and assembly. FIG. 7 depicts an embodiment treating valve assembly 310 of the present disclosure that includes a normally-closed ported sleeve assembly 312 located upwell from a normally-open flapper assembly 314. The ported sleeve assembly 312 and the flapper assembly 314 can each transition between four states: (i) a neutral state, which is shown in FIG. 7; (ii) a "first shifted" state, as shown in and described with reference to FIG. 8; (iii) a "second shifted" state, as shown in and described with reference to FIG. 9; and (iv) an "actuated" state, as shown in and described with reference to FIG. 10. When used with reference to the normally-closed ported sleeve assembly 312, "actuated" means that the ports 316 are opened (e.g., uncovered) to allow flow therethrough. When used with reference to the normally-open flapper assembly 314, "actuated" means that the flapper plate 318 is in a closed position.

The depicted ported sleeve assembly 312 includes a movable port sleeve 320 that covers the ports 316 to prevent flow therethrough when the ported sleeve assembly 312 is in the closed position. Embodiments of the present disclosure may include an additional cover 322, such as a composite sleeve or similar member, positioned external to or otherwise in association with the ports 318, for preventing the entry of fluid, or possible damage thereto or occlusion thereof, such as when the embodiment 310 is being inserted into a wellbore. The cover 322 can be removed, displaced, eroded, or otherwise overcome when fracturing fluid is provided through the ports 318, or prior thereto. The movable port sleeve 320 abuts a shoulder in a top connection 324 at one end and a lock ring 326 or similar connecting member and a flapper sleeve 328 within the flapper assembly 314 at the opposing end, such that the port sleeve 320 is connected to the flapper sleeve 328, and thus to the plug seat 332. Further, the system includes a restraining member, which in some embodiments may be one or more shear pins 329, to generally restrain port sleeve 320, flapper sleeve 328, ball seat 332, slotted member 336, collet retainer 350, and collet 348 from axial movement until the appropriate force, such as a pressure differential across the ball seat 332, is applied to the embodiment 310. The lock ring 326 engages the port sleeve 320 to the flapper sleeve 328 when the embodiment 310 is in the neutral position, as shown in FIG. 7.

The depicted flapper assembly 314 is shown having the flapper plate 318 rotatably attached to a pivot 330 such that the flapper plate 318 is movable between an open position, as shown in FIG. 7, in which the flowpath through the treating sleeve assembly adjacent to the flapper is generally unrestricted, and a closed position, in which the flapper plate 318 pivots to impede the flowpath and engage an associated flapper seal to prevent downwell flow while allowing fluid to pass the flapper plate 318 in the upwell direction. The flapper sleeve 328 retains the flapper plate 318 in the open position and is shown abutting the movable port sleeve 320 at one end and a seat 332 or similar sealing surface at the opposing end thereof. The depicted flapper assembly 314 also includes an outer housing 334, which is shown connected to the top connection 324 at one end by, for example, threaded connections that are well known in the art. However, neither this nor any other connection of the embodiments of this disclosure rely on any particular type of connection unless expressly set out in the claims.

A slotted member 336 is shown positioned downwell from the seat 332, the slotted member 336 having one or more walking J-slots 338 formed therein. One or more torque pins 340 or similar members can extend through the outer housing 342 of the slotted member 336 to engage the walking J-slots 338. In the depicted embodiment, an adapter sub 344 and associated connection 346 are used to connect the slotted member 336 with the upwell portions of the embodiment 310; however, it should be understood that in various embodiments, use of adapter subs and similar connections can be omitted, or other types of connections can be used. A collet 348 and collet retainer 350 are also shown positioned within the outer housing 342. The slotted member 336 can have a configuration identical or substantially similar to that of the slotted member 54, shown in FIG. 2, having a continuous radial path that includes a repeated pattern of neutral positions and shifted positions, terminating in an actuated position positioned downwell of the neutral positions; however, it should be understood that a usable slotted member can include any number and configuration of slots and positions, depending on the dimensions and biasing forces of other portions of the embodiment 310. For example, FIGS. 11A and 11B, described below, depict an embodiment of a slotted member usable with the embodiment 310 shown in FIGS. 7-10.

A spring housing 352 containing a compression spring 354 is shown downwell from the slotted member 336, such that the compression spring 354 abuts the collet 348 and applies a force that urges the collet 348 in an upwell direction, which in turn biases the slotted member 336, seat 332, flapper sleeve 328, movable port sleeve 320, and any associated subs and/or connectors, in an upwell direction to retain the movable port sleeve 320 in the closed position and the flapper plate 318 in the open position. The spring housing 352 is shown engaging a bottom connection 354 via a connector 356, though it should be understood that in various embodiments, the spring housing 352 could be directly engaged to or integral with a bottom connection. While FIG. 7 depicts a compression spring 354, it should be understood that any manner of biasing member (e.g., mechanical, pneumatic, hydraulic) usable to provide a force in the upwell direction can be used without departing from the scope of the present disclosure.

In operation a plug (e.g., a ball, dart, or similar member) can be provided into the fluid pathway of the embodiment 310, through which the plug will pass until it engages the seat 332 or similar sealing surface, thereby preventing the flow of fluid past the seat 332. For example, a ball having a diameter larger than that of the flowpath through the seat 332 would engage the surface of the seat 332 to form a seal and prevent further flow of fluid through the seat 332. Continued application of pressure into the flowpath within the interior of the embodiment 310 can then cause creation of a pressure differential across the seat 332 due to the presence of the plug. Once the pressure differential reaches a selected threshold, which can be determined through the tolerance of one or more shear pins or similar elements used to secure elements of the embodiment 310 in a generally fixed axial position, and/or through the expansive force of the spring 354, the seat 332, flapper sleeve 328, port sleeve 320, slotted member 336, collet retainer 350, and collet 348 are moved in a downhole direction, thereby compressing the spring 354.

Figure 8:
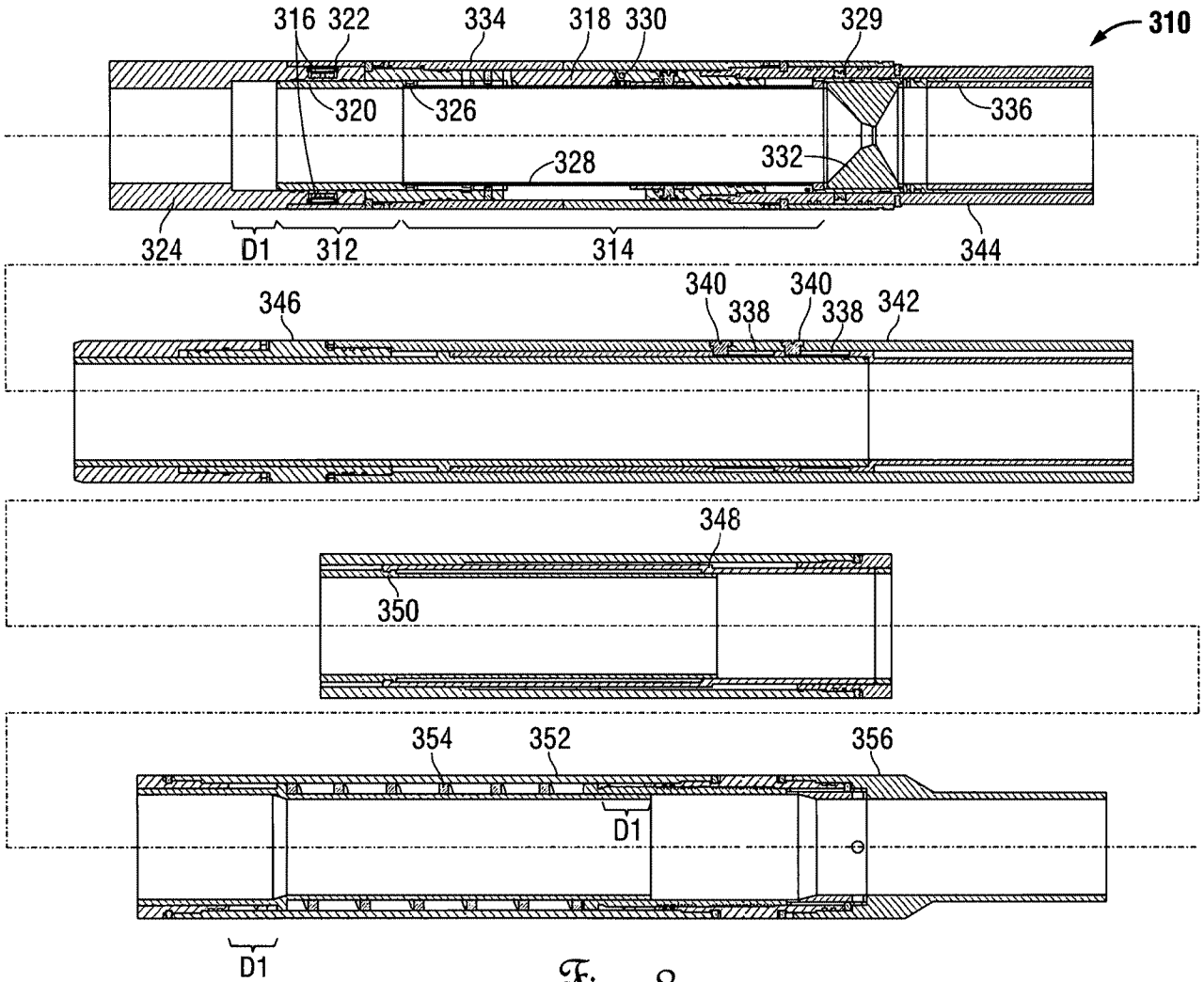
FIG. 8 is a side sectional elevation view of the embodiment shown in FIG. 7 in a first shifted state.

Movement of the seat 332, flapper sleeve 328, port sleeve 320, slotted member 336, collet retainer 350, and collet 348, caused by the pressure differential, continues until such movement is limited by contact between the torque pins 340 and the J-slots 338, at which point the embodiment 310 is in the "shifted" position, as shown in FIG. 8. As such, FIG. 8 depicts the J-slots 338 displaced relative to the torque pins 340, relative to the position shown in FIG. 7, such that the torque pins 340 occupy one of the "shifted" positions in the corresponding J-slots 338. FIG. 8 also depicts the spring 354 compressed a first distance D1 responsive to movement of the port sleeve 320, flapper sleeve 328, slotted member 336, and collet 348 a substantially equal distance D1. The collet retainer 350 is also displaced a substantially equal distance D1, such that the collet 348 and collet retainer 350 remain in association.

While the embodiment illustrated in FIGS. 7 thru 10 have the j-slots 338 moving while the torque pins 340 remain stationary, the present disclosure encompasses embodiments wherein the j-slots remain stationary and the torque pins move within the j-slot.

Because continued movement of the seat 332, flapper sleeve 328, port sleeve 320, slotted member 336, and collet 348 is limited by contact between the torque pins 340 and the corresponding "shifted" position in the J-slots 338, an increased pressure differential caused by the presence of a plug within the seat 332 can extrude and/or otherwise cause the plug to pass the seat 332, thereby equalizing pressure across the seat 332 and permitting the spring 354 to expand and return the seat 332, flapper sleeve 328, port sleeve 320, slotted member 336, and collet 348 to the "neutral" position shown in FIG. 7.

Figure 11A:
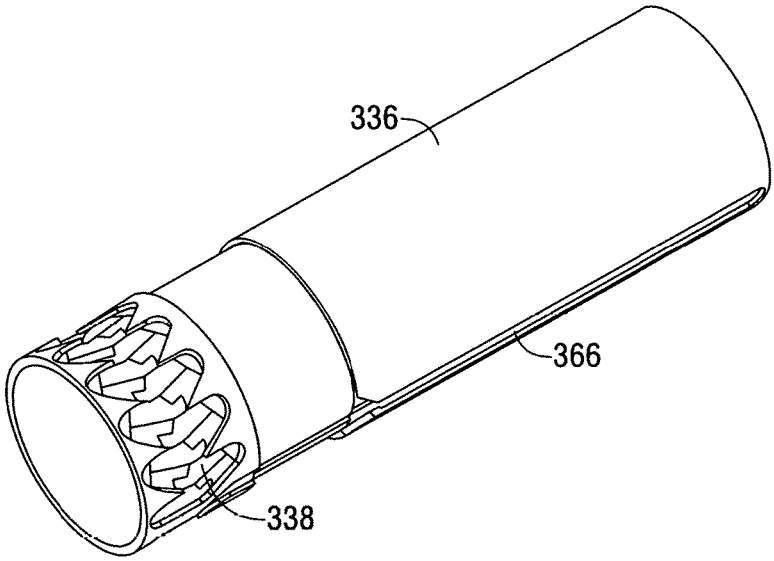
FIG. 11A is an isometric view of an embodiment of a slotted member usable with the embodiment of the apparatus shown in FIG. 7.
Figure 11B:
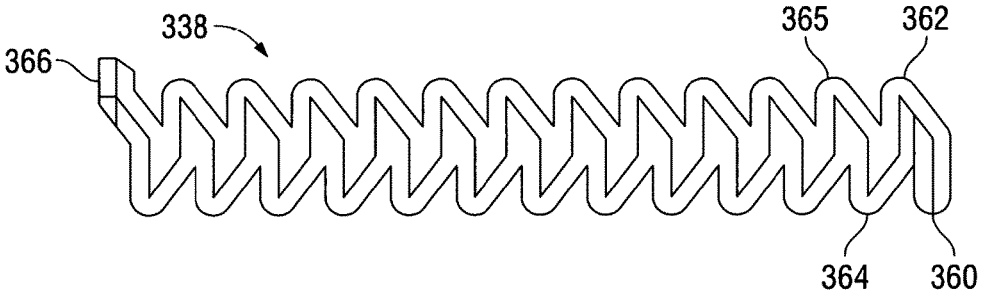
FIG. 11B shows the footprint of a slot formed in the exterior of the slotted member of FIG. 11A.

As described previously, such a sequence can be repeated, and treating sleeve assembly indexed, a selected number of times, depending on the number of "shifted" and "neutral" positions included in the J-slots 338, until the torque pins 340 reach the final neutral position. Thereafter, the next plug that seals within the seat 332 can cause the slotted member 336 to move relative to the torque pins 340 such that the torque pins 340 move to an actuated position within the slots 338. For example, FIG. 11A depicts an isometric view of an embodiment of a slotted member 336 having a walking J-slot 338 formed in the exterior surface thereof. FIG. 11B shows the footprint of the J-slot 338, which is depicted having a first neutral position 360 located at an end thereof, a first shifted position 362 adjacent to the first neutral position 360, a plurality of additional neutral positions, and a plurality of additional shifted positions, of which an exemplary neutral position 364 and shifted position 365 are labeled for reference. The J-slot 338 is shown including an actuated position 366 at the end of the slot 338 opposite the first neutral position 360, the actuated position 366 extending at least partially along the length of the slotted member 336, as shown in FIG. 11A.

As described previously, a torque pin need not necessarily be positioned in the first neutral position 360 prior to inserting the embodiment 310 into a wellbore; a torque pin could be positioned within any of the neutral positions, as desired, depending on the number of times the embodiment 310 is intended to be shifted prior to actuation thereof. Each engagement of a ball or plug within the seat 332 can cause displacement of the slotted member 336 in a downhole direction, such that the torque pin 340 moves from a neutral position to the next adjacent shifted position. The biasing force applied to the slotted member 336 by the spring 354 after passage and/or removal of the plug from the seat 332 can then cause displacement of the slotted member 336 in an uphole direction, such that the torque pin 340 moves to the subsequent neutral position. Once the torque pin 340 reaches the final neutral position, the next plug that engages the seat 332 will cause displacement of the slotted member 336 such that the corresponding torque pin 340 moves to the actuated position 366.

Figure 9:
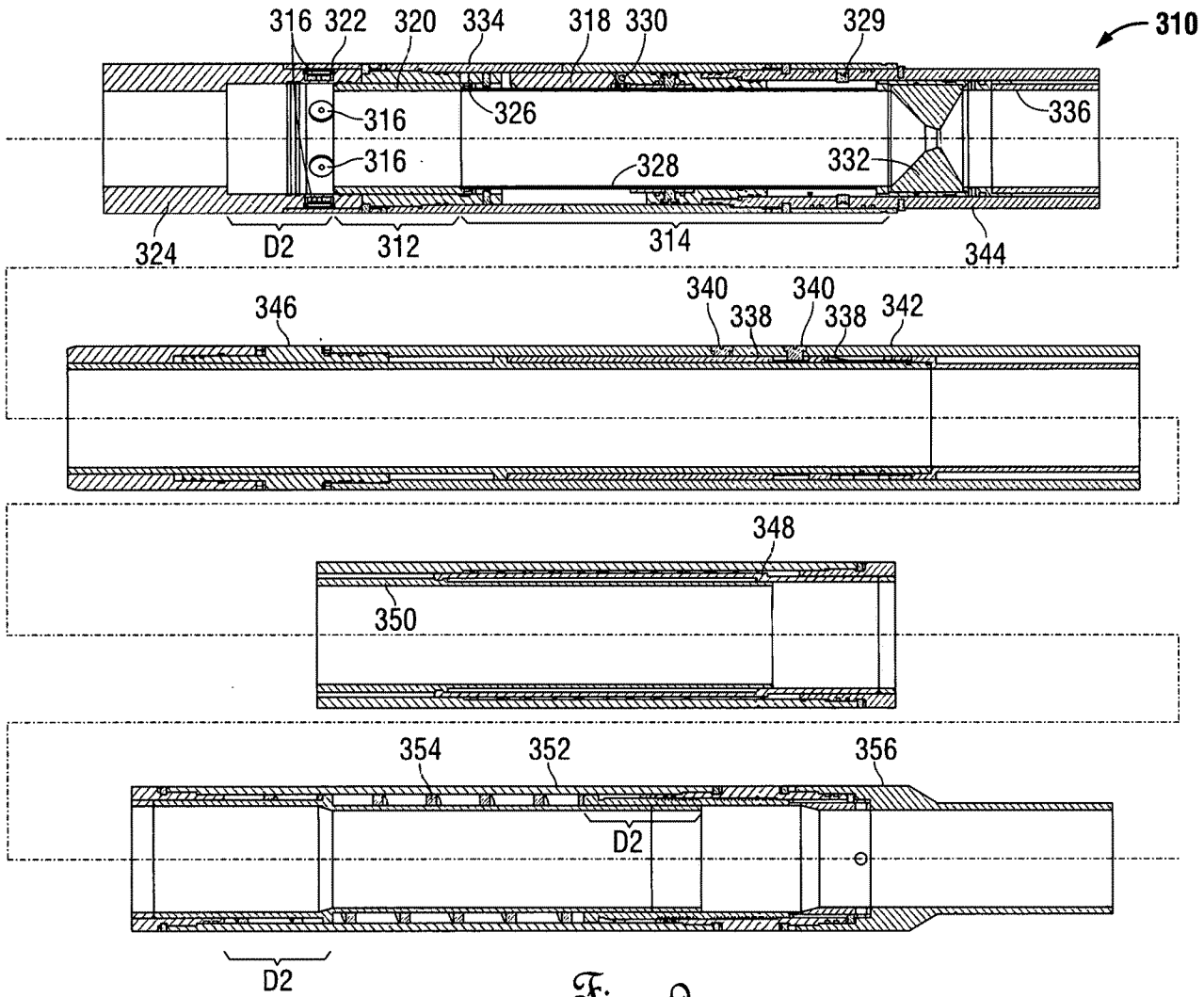
FIG. 9 is a side sectional elevation view of the embodiment shown in FIG. 7 in a second shifted state.

FIG. 9 depicts the embodiment 310 after movement of the torque pin 340 to the actuated position, thereby showing the embodiment 310 in a "second shifted" position prior to actuation thereof. Due to the length of the portion of the J-slot 338 containing the actuated position 366, greater compression of the spring 354 and axial movement of the seat 332, flapper sleeve 328, port sleeve 320, slotted member 336, retainer 350, and collet 348 in a downhole direction is permitted, compared to the position shown in FIG. 8, in which the position of the torque pin 340 within a "shifted" portion of the J-slot 338 impedes further axial movement of the seat 332, flapper sleeve 328, port sleeve 320, slotted member 336, retainer 350, and collet 348.

As such, FIG. 9 depicts the J-slots 338 displaced relative to the torque pins 340, relative to the position shown in FIGS. 7 and 8, such that the torque pins 340 occupy the "actuated" positions in the corresponding J-slots 338. FIG. 9 also depicts the spring 354 compressed a second distance D2 responsive to movement of the port sleeve 320, flapper sleeve 328, slotted member 336, and collet 348 a substantially equal distance D2. The collet retainer 350 is also displaced a substantially equal distance D2, such that the collet 348 and collet retainer 350 remain in association. Movement of the movable port sleeve 320 the second distance D2 aligns the lock ring 326 with a slot 327, notch, groove, or similar corresponding feature, such that when the port sleeve 320 reaches the position depicted in FIG. 9, the lock ring 326 is permitted to expand into the slot 327, thereby decoupling the port sleeve 320 from the flapper sleeve 328 of the flapper assembly 314.

Figure 10:
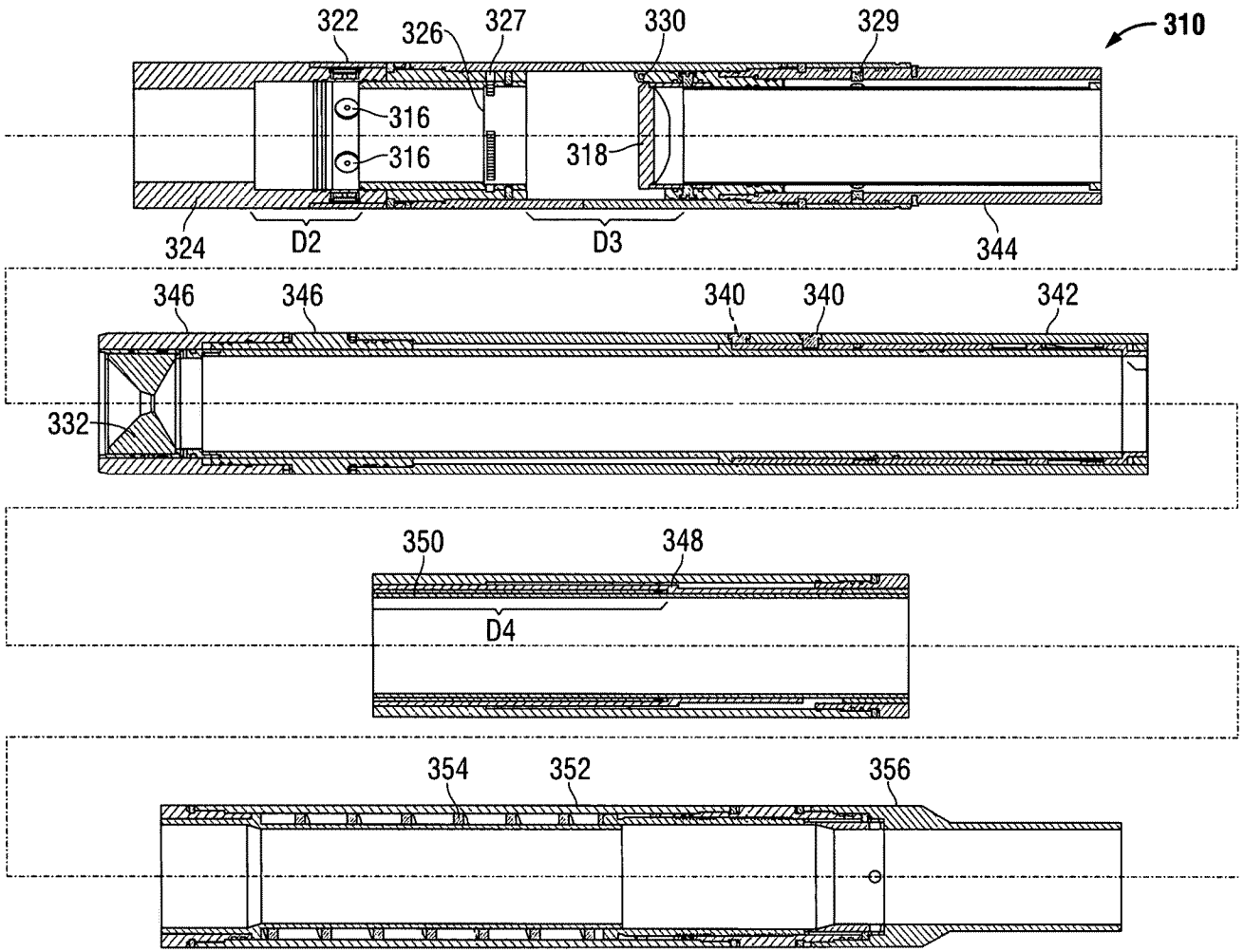
FIG. 10 is a side sectional elevation view of the embodiment shown in FIG. 7 in an actuated state.

The continued application of force caused by the pressure differential, created by the presence of a plug within the seat 332, can cause the seat 332, flapper sleeve 328, slotted member 336, and collet retainer 350 to move an additional distance in the downhole direction while the port sleeve 320 is retained in the position shown in FIG. 9 due to the engagement of the lock ring 326 within the slot 327. Continued movement of the seat 332, flapper sleeve 328, slotted member 336, and collet retainer 350 continues until the embodiment 310 reaches the "actuated" position, as shown in FIG. 10. In an embodiment, further movement beyond the actuated position can be limited by the length of the J-slot 338.

Specifically, FIG. 10 depicts the movable port sleeve 320 displaced the second distance D2, such that the lock ring 326 engages the slot 327 to prevent further movement of the port sleeve 320. In the depicted embodiment, movement of the port sleeve 320 the second distance D2 is sufficient to uncover the ports 316 to enable the flow of fluid therethrough. The flapper sleeve 328, seat 332, and slotted member 336 are shown displaced an additional distance D3 such that the flapper sleeve 328 no longer prevents movement of the flapper plate 318 to a closed position. As such, FIG. 10 depicts the flapper plate 318 in a closed and/or actuated position, such that fluid flow through the embodiment 310 in a downhole direction is prevented, while uphole flow can be permitted by pivoting of the flapper plate 318 at the pivot 330.

The downhole force applied by the pressure differential and/or the uphole force applied by the compressed spring 354 can be sufficient to overcome the engagement between the collet 348 and collet retainer 350, such that movement of the flapper sleeve 328, seat 332, and slotted member 336 from the second shifted position, shown in FIG. 9 to the actuated position, shown in FIG. 10 causes the disengaged collet retainer 350 to be movable in a downhole direction relative to the collet 348 (e.g., through continued downhole movement of the flapper sleeve 328, seat 332, and slotted member 336), and/or the collet 348 to be movable in an uphole direction relative to the collet retainer 350 (e.g., through expansion of the spring 354), such that the collet 348 and collet retainer 350 overlap in a telescoping relationship. Disengagement of the collet 348 from the collet retainer 350 in this manner decouples the spring 354 from the flapper sleeve 328, seat 332, and slotted member 336, such that expansion of the spring to its original neutral position does not apply an uphole force to the flapper sleeve 328, seat 332, and slotted member 336, but instead causes relative movement between the collet 348 and collet retainer 350. Thus, after actuation of the embodiment 310, a plug can be extruded through or otherwise pass or overcome the seat 332, e.g., to actuate or shift subsequent devices, while the expansion of the spring enabled by the removal of the plug from the seat 332 is prevented from reversing the actuation of the embodiment 310 due to the disengagement of the collet 348 from the retainer 350.

It will be appreciated that an appropriate plug seat, such as the plug seat illustrated in FIGS. 7 through 10, may be substituted for the inner engagement surfaces 39, 87 in FIGS. 1, 3A, 4, and 5. Further, different plug seat designs may be used in connection with embodiments of the present disclosure with such design selected dependent on the particular plug, or no plug, to be used.

Figure 12A:
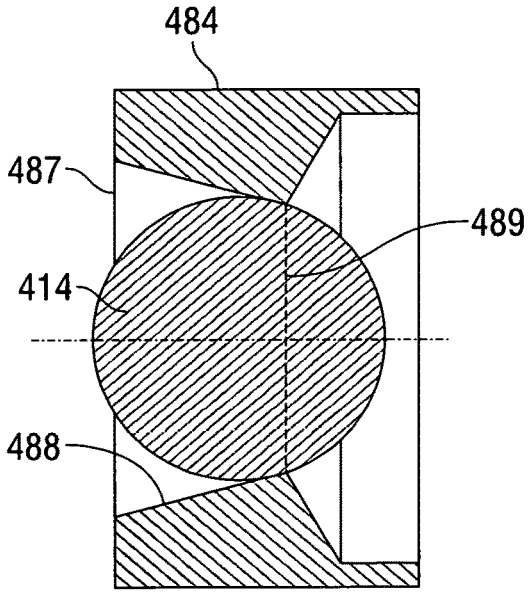
FIGS. 12A and 12B show two embodiment plug seats

For example, in the illustrative embodiment of FIG. 12*a*, the plug seat 484 contains a sealing section 88 with a generally conical profile such that the inlet 487 of the sealing section 488 has a diameter greater than diameter of the plug 414 and the opening 489 of sealing section 488 has a diameter smaller than the diameter of plug 414. The distance between the inlet 487 and opening 489 combined with the difference between their diameters define an angle of the seating section's 488 generally conical profile.

Figure 12B:
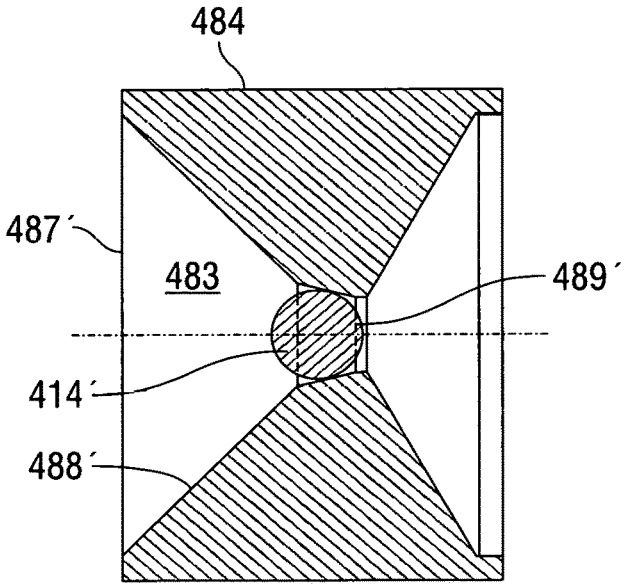

In one embodiment, the hardness of the ball seat 484 is greater than the hardness of the plug, shown in FIGS. 12A and 12B as a ball 414. Thus, as force is applied to the ball 414 while in the seating section 488, the ball 414 compresses or otherwise deforms before the ball seat 484 expands. More particularly, the ball 414 compresses or deforms sufficiently to pass through the opening 489 of the ball seat 484 while the diameter of the opening 489 remains substantially the same. After passing through the opening 489, the ball 414 returns substantially back to its original size and shape.

In another embodiment, the ball 414 or other plug is comprised of a resilient deformable material. The term "resilient deformable material" as used herein means any material that, when formed into a sphere, cone, or cylinder, can be forced through a circular opening having a diameter less than the largest diameter of the sphere, cone, or cylinder and that returns to substantially its original size and shape after passing through the circular opening. For clarity, the use of the term resilient deformable material herein does not limit the scope of the claims to plugs, plug seats, or any other claimed structure to cones, spheres, cylinders, any other specific geometric shape, or any combination thereof. Certain of such plugs and plug seats are disclosed in U.S. patent application Ser. No. 13/423,154 "Downhole System and Apparatus Incorporating Valve Assembly With Resilient Deformable Engaging Element," the entirety of which is incorporated by reference as if fully set forth herein.

In operation, the diameter of the plug contacts sealing section 488 between inlet 487 and opening 489. When the pressure at inlet 487 exceeds the pressure at opening 489, the plug begins to compress or deform, or both, causing the diameter of the plug which is contact with seating section 88 to shrink, allowing the plug to move towards opening 489. If the pressure differential between inlet 487 and opening 489 is sufficiently high, the diameter of the plug 414 which contacts seating section 488 shrinks to the diameter of the opening 489, or to a diameter slightly smaller than the diameter of opening 489, allowing the plug 414 to pass through the opening 489 and out of the plug seat 484. As appreciated by those of skill in the art, the passage of plug 414 through the opening 489 of the plug seat 484 allows the pressure at opening 89 to equalize with the pressure at inlet 487.

FIG. 12B shows an alternative ball seat 484' from a preferred embodiment, which is for use with a ball 414' the diameter of which is small relative to the outer diameter of the ball seat 484. Like the ball seat 484 shown in FIG. 1, the ball seat 484' of FIG. 2 has a sealing section 488' with an inlet 487' and opening 489' and the distance between inlet 487' and opening 489' defines an angle of the generally conical profile. The ball seat 484 of FIG. 12B has an "entry section" 483 to funnel the ball 114' into the seating section 488', thereby helping to ensure that a ball of relatively small diameter will engage with the appropriate seating section 488'. Such entry section may be present or absent in ball seats or other plug seats of the present disclosure.

The fluid pressure that the valve assembly will hold is determined by the physical properties of the plug, including its size, shape, and material composition, and the diameter of the opening 489, 489' of seating section 488, 488'. Specifically, when the fluid pressure is greater at the inlet 487, 487' than at the opening 489, 489', the plug is forced towards the opening. If this difference in pressure between the inlet and opening (i.e., the "pressure drop") becomes sufficiently high, the plug is forced through the inlet and can then move down the well or tubing to engage the next seat. The pressure drop necessary to force the plug through its corresponding seat or other plug seat is a function of the size of the opening 89 as well as the size of the plug and the materials used to make the plug.

The length of the opening through the seat is in some embodiments one-eighth inch, which allows the ball to extrude through the opening nearly immediately upon application of the target pressure differential. Increasing the length of the opening 89 increases the effect of friction on the ball, which may increase the required time and/or pressure to move the ball 414, 414' through the opening 489, 489'.

When a plug seat with a static opening size is used together with one or more extrudable plugs, a retainer element, such as a collet, shear pin, or other part, device or assembly, may be chosen to increase the number of stages for a given plug seat size. Specifically, a retainer element may be chosen such that an appropriately sized plug of a softer material will extrude at a pressure lower than the pressure needed to overcome the retainer element. Thus, engagement of such softer plug will not advance the torque pins in the j-slot or otherwise index a treating sleeve assembly that indexes by axial movement of the plug seat. A second plug, made of harder material, may then be used. Such second plug would be chosen such that it does not extrude through the plug seat below a pressure differential across the plug seat that is greater than the pressure differential required to overcome the retainer element. In this way, plugs of the same size and shape but of different material composition, can be used to either increase the total number of stages or to maximize the size of the plug seat openings for the treating sleeves used in the well.

Figure 13:
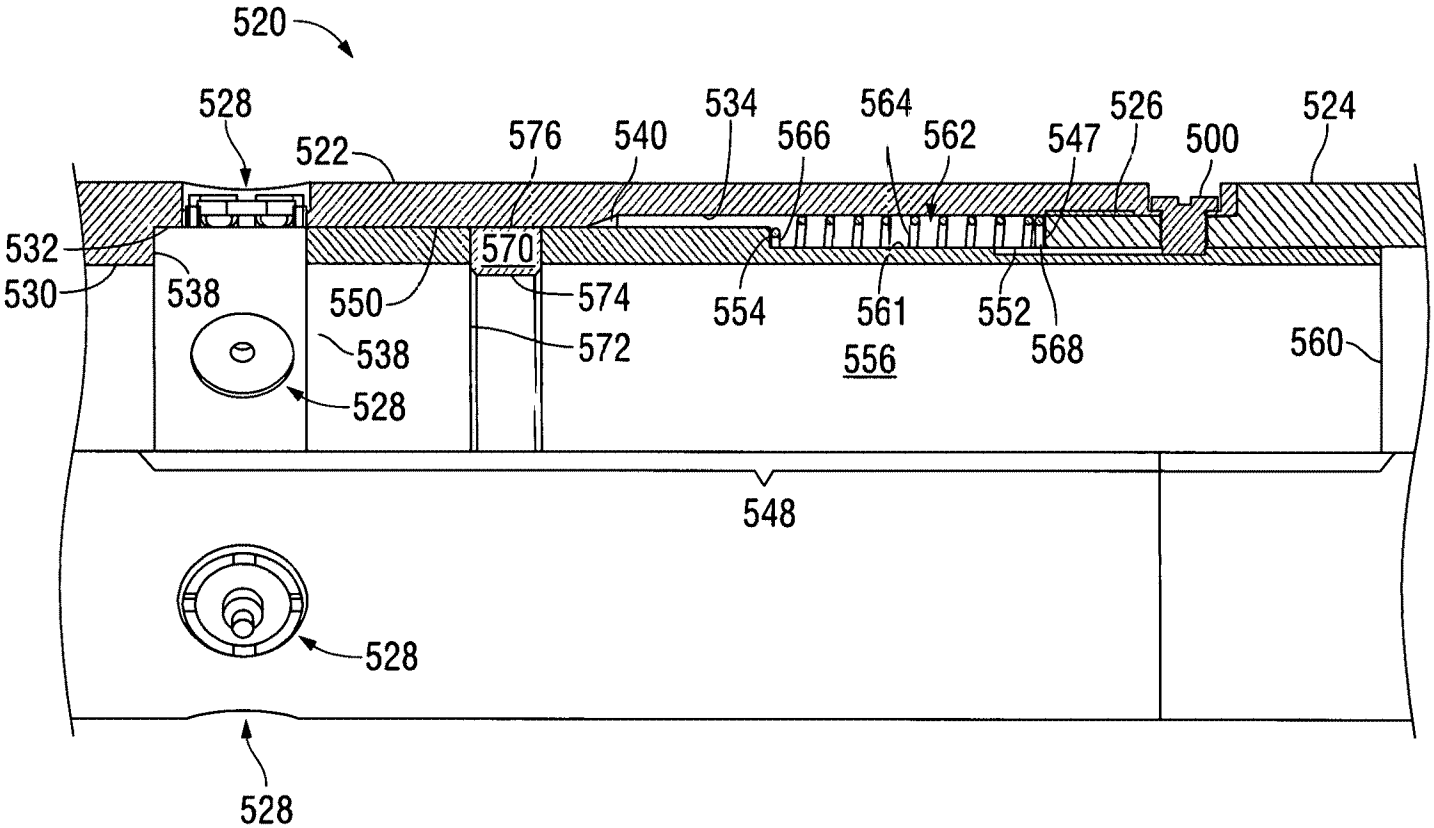
FIG. 13 shows an embodiment plug seat assembly comprising an expandable split ring, or "c-ring" with a slotted sleeve and spring guide assembly.

FIG. 13 shows another embodiment plug seat and plug seat assembly usable with the treatment sleeve assembly of the present disclosure. Such plug seat comprises an expandable split ring, or "c-ring" disposed within variable diameter housing and a guide element or guide assembly. The operation of such a plug seat is further described below.

The embodiment tool 520 of FIG. 13 is actuatable by a plug seat assembly having a slotted sleeve 548 and a torque pin 500. The tool 520 comprises a housing 522 connected to a bottom connection 524 at a threaded section 526. The housing 522 has a plurality of radially-oriented, circumferentially-aligned ports 528 providing communication paths to and from the exterior of the tool 520.

The housing 522 has a first cylindrical inner surface 530 having a first inner diameter, a second cylindrical inner surface 532 located downwell of the first inner surface 530 and having a second inner diameter that is greater than the first inner diameter, and a third cylindrical inner surface 534 having a third inner diameter that is greater than the second cylindrical inner surface 532. The first inner surface 530 is longitudinally adjacent to the second inner surface 532, forming a downwell-facing shoulder having an annular shoulder surface 538. The second and third inner surfaces 532, 534 are separated by a partially-conical surface 540.

The tool 520 comprises an annular sleeve 548 nested radially within the housing 522 and positioned downwell of the shoulder 538. The sleeve 548 has an upper outer surface 550 with a first outer diameter and a second outer surface 552 with a second outer diameter less than the first inner diameter. The first outer surface 550 and second outer surface 552 are separated by an annular shoulder surface 554. The sleeve 548 further comprises a cylindrical inner surface 556 that extends between annular upper and lower end surfaces 558, 560 of the sleeve 548.

The tool 520 may further comprise a guide element to position the plug seat of the valve assembly at the desired location. The guide element in the embodiment of FIG. 9 is a spring 564 residing in an annular spring return space 562. The annular spring return space 562 is partially defined by the second outer surface 552 of the sleeve 548 and the third inner surface 534 of the housing 522. The spring return space 562 is further defined by the upper end surface 547 of the bottom connection 524, the partially-conical surface 540 of the housing 522, and the shoulder surface 554 and first outer surface 550 of the sleeve 548.

In the embodiment illustrated by the figures, a C-ring 570 is positioned within the annular sleeve 548 between the upper end surface 558 and the shoulder surface 554. The C-ring 570 fits into a groove formed in the inner surface 556 of the shifting sleeve 548. The groove is sufficiently deep to allow the C-ring seating surface to expand to the desired maximum diameter. In some embodiments, the desired maximum diameter may be as large as or larger than the inner diameter of the shifting sleeve. Those of skill in the art will appreciate that, in embodiments in which the C-ring 570 activates a sleeve or other valve assembly, the C-ring 70 may be positioned at any point along the sleeve or tool, or above or below the sleeve, provided that the C-ring 570 and the sleeve 548 or other tool are connected such that sufficient pressure applied to the C-ring 570 will slide the sleeve in relation to the inner housing or otherwise activate the tool.

The C-ring 570 has an inner surface 574 an outer surface 576 defining the outer perimeter of the C-ring 570, and a seating surface 572 engagable with a plug (e.g., a ball or dart) having a corresponding size. In the illustrated embodiment, the C-ring 570 is held in a radially compressed state by the first inner surface 550 of the housing 522.

The plug seat assembly includes a guide element that has a counting element, a timing element, an indexing element or other device for recording or reflecting the plugs which engage and pass through the assembly or for recording or reflecting the pressure drops exceeding a pre-determined value which occur across the plug seat. In certain embodiments, such as the embodiment illustrated in FIG. 13, a counting element includes a guiding member, such as a torque pin 500, and a slot 502 formed in the exterior surface 561 of the sleeve 548. The torque pin 500 is fixed relative to, and extends through, the housing 522 and bottom connection 524.

In FIG. 13, the torque pin 500 is positioned in a "neutral" position of the slot 502, which is identical to the slot shown in and described with reference to FIGS. 2A-2B, 3B-3D, 11A-11B, and is a continuous path formed of intersecting discrete, straight path segments. The slot 502 extends radially around, and is formed in, the exterior surface 561 of the sleeve 548. The guiding element is positioned in a neutral position of the slot 502, with the upper end 558 of the sleeve 548 positioned below the ports. As above, the sleeve 548 can transition between three positions: (i) a neutral position, which is shown in FIG. 13; (ii) a "shifted" position, not show; and (iii) an "actuated" position, as shown in and described with reference to FIG. 16.

Figure 14:
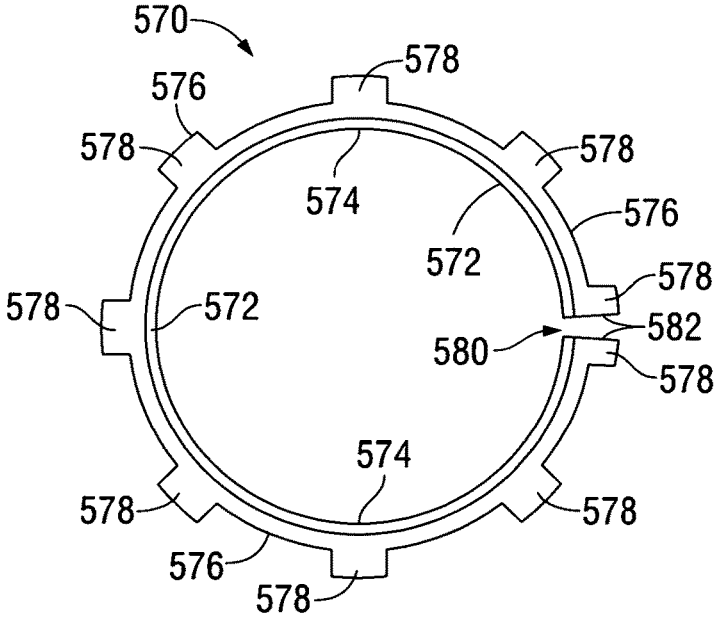
FIG. 14 shows one embodiment of an expandable split ring or "c-ring" plug seat.

FIG. 14 shows a front elevation of one embodiment of a C-ring 570 in a normal uncompressed state. In this embodiment, the outer surface 576 of the C-ring 570 is castellated with a plurality of radial protrusions 578, said radial protrusions defining the outer diameter of the C-ring 570. The circumference of the outer surface of the C-ring 570 may be larger than the circumference of inner surface 556 of the sleeve 548. The C-ring 570 has a machined slot 580 forming terminal ends 582. The slot 580 shown in the illustrative figures is within a protrusion 578, but the slot 580 may be formed at any point along the C-ring 570 and does not have to be formed in a protrusion 578.

Figure 15:
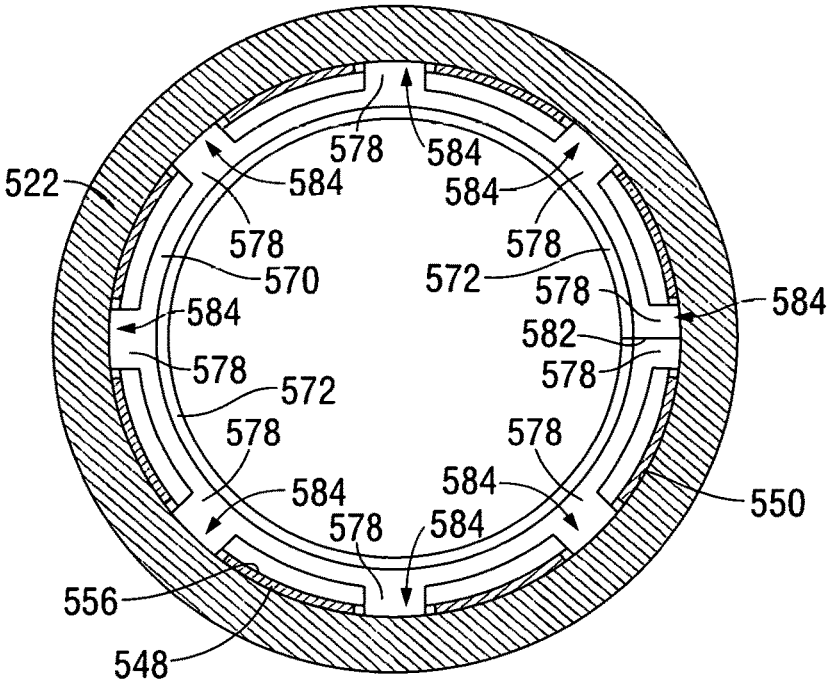
FIG. 15 shows a cross section of one embodiment of a plug seat assembly having expandable split ring or "c-ring" plug seat.

Referring to FIG. 15, each of the radial protrusions 578 of the illustrated C-ring 570 is aligned with and extends through an opening 584 in the sleeve 548 between the first outer surface 550 and the inner surface 556. When the C-ring 570 is upwell of the partially-conical shoulder 540 of the housing 522, the C-ring 570 has the operating diameter shown in FIG. 11 and terminal ends 582 of C-ring 570 are in contact to form the seat defined by the seating surface 572. An associated plug may thereafter seat against the seating surface 572 and a pressure differential created across the plug to move the sleeve 548 in the downwell direction.

Figure 16:
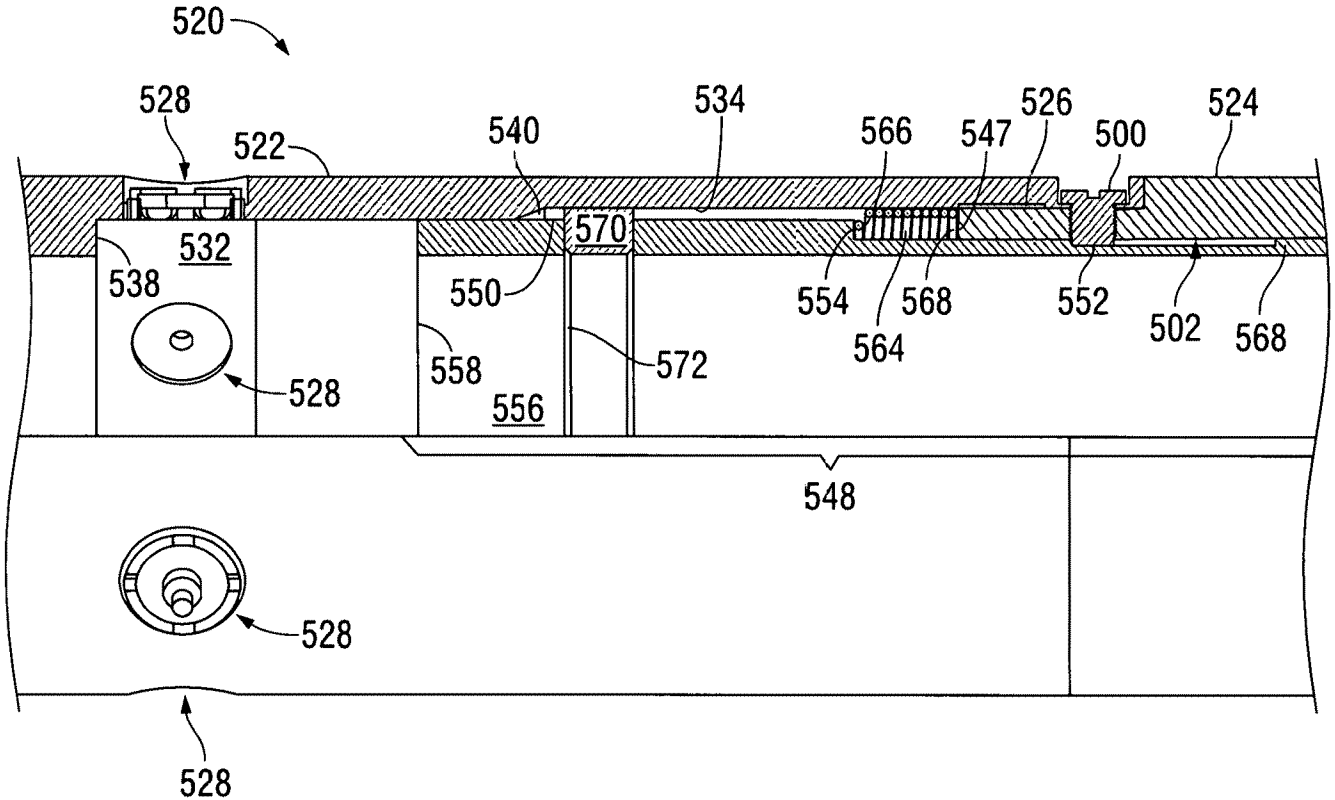
FIG. 16 shows an embodiment plug seat assembly comprising an expandable split ring, or "c-ring" with a slotted sleeve and spring guide assembly, with the spring in the compressed position such that the assembly is actuated.

FIG. 16 shows an embodiment treating sleeve assembly 520 with the sleeve 548 in a shifted position, which is downwell of the position shown in FIG. 13. The coil spring 564 is under compression between the sleeve 548 and the bottom connection 524, with the upper end coil 566 of the spring 564 in contact with the sleeve shoulder 554 and the spring lower end 568 is in contact with the upper end surface 547 of the bottom connection 524. In this position, the spring 564 exerts an expansive force to urge the sleeve 548 in the upwell direction relative to the bottom connection 524. The torque pin 500 is positioned in a "shifted" position of the slot 502.

The C-ring 570 is positioned adjacent to the second inner surface 534. Because the second inner surface 534 has a larger diameter than the first inner surface 532, the C-ring 570 radially expands towards its uncompressed shape shown in FIG. 14. The protrusions 378 extend past the outer surface 550 of the sleeve 548, opening the seating surface 572 and allowing the associated plug to pass through the C-ring 570, after which the spring 564 pushes against the sleeve shoulder 554 to move the sleeve 548 upwell.

In some embodiments, a retaining element, not shown, may be placed in the sleeve to define this intermediate position, such retaining element being set such that it stops movement of the C-ring 570 and sleeve up to a first pressure, but allows movement of the C-ring 570 at a second pressure. Those of skill in the art will appreciate that many retaining elements such as a shear ring, shear pins, or other device may be used in conjunction with the valve assemblies described herein. Further, mechanisms, assemblies, methods or devices other than a retaining element may be used for defining the intermediate third position in a valve assembly and any such method or element is within the scope of the valve assemblies contemplated herein.

According to another embodiment, the plug seat may comprise a plurality of seat segments interconnected with at least one elastomeric member, as disclosed in U.S. application Ser. No. 12/702,169, filed Feb. 28, 2010 and entitled "Downhole Tool With Expandable Seat," the entirety of which is incorporated by reference as if fully set forth herein. In this alternative embodiment, the plug seat is moveable between a first section of a housing, said first section having a first inner diameter. The housing has a second section downwell from said first section and having a second inner diameter greater than said first inner diameter. The first inner diameter is sized to prevent expansion of the plug seat when the plug seat is positioned in said first section, whereas the second inner diameter is sized to allow expansion of the expandable seat when in the second position. Any other plug seat-plug combination is within the scope of the claimed invention provided such combination allows the creation of a desired pressure drop across the plug seat, the release of the plug past the plug seat, and the plug is substantially undamaged or otherwise not deformed such that it can form a fluid seal with a subsequently engaged plug seat.

It will be appreciated that C-rings or expandable split rings of different designs, such as, without limitation, designs with crenellations and/or designs that do not protrude through the sleeve or sleeves to be shifted are within the scope of the present disclosure as well as the claims. Any c-ring is permissible provided it is capable of opening and closing a desired number of times to allow for the treating sleeve assembly to be indexed through multiple cycles.

An embodiment of a treating sleeve assembly of the present disclosure may comprise a multiple plug seat assembly in which a plurality of plug seats are connected to the same port sleeve, flapper sleeve, and/or connected port sleeve and flapper sleeve. One such system would have an upper C-ring 670 fixed to the sleeve 648 and a lower seat 604 spaced sufficiently apart to allow a first ball 606 of a particular size to seat on the lower seat 604 without engaging or interfering with the upper seat 672. Systems in which the first ball engages the upper seat 672 without interfering with the lower seat 604 are also possible. A first ball 606 engages the lower seat 604 and, using fluid pressure, shifts the sleeve 648 to allow compression of the upper seat 672 by positioning the upper seat 672 such that the outer surface 676 of the C-ring 670 engages a smaller diameter surface 602 or appropriately positioned dogs. The C-ring 670 of the upper seat 672 becomes compressed and can thereafter engage a second ball 608 of a diameter selected for use with the upper seat 672. It will be appreciated that, in the uncompressed state, the upper C-ring 670 is configured such that plugs large enough to engage the lower seat 600 will pass without engaging the upper C-ring 670. Further, the upper C-ring 670, when compressed, will engage balls with a diameter that is too small to engage and hold pressure on the lower seat 604.

Figure 17A:
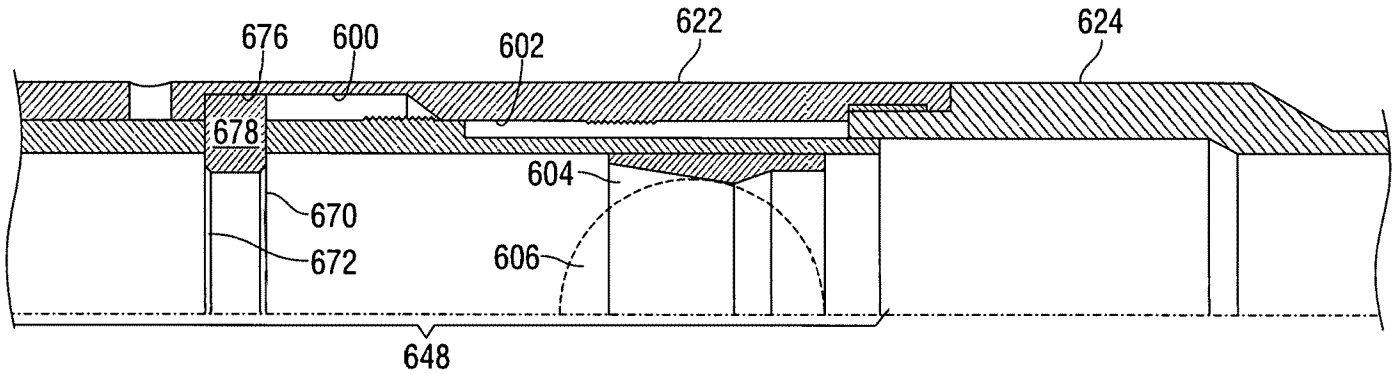
FIGS. 17A and 17B show an embodiment of a multiple seat plug seat assembly in which a first plug initiates the assembly for further indexing and/or actuation by a second plug.
Figure 17B:
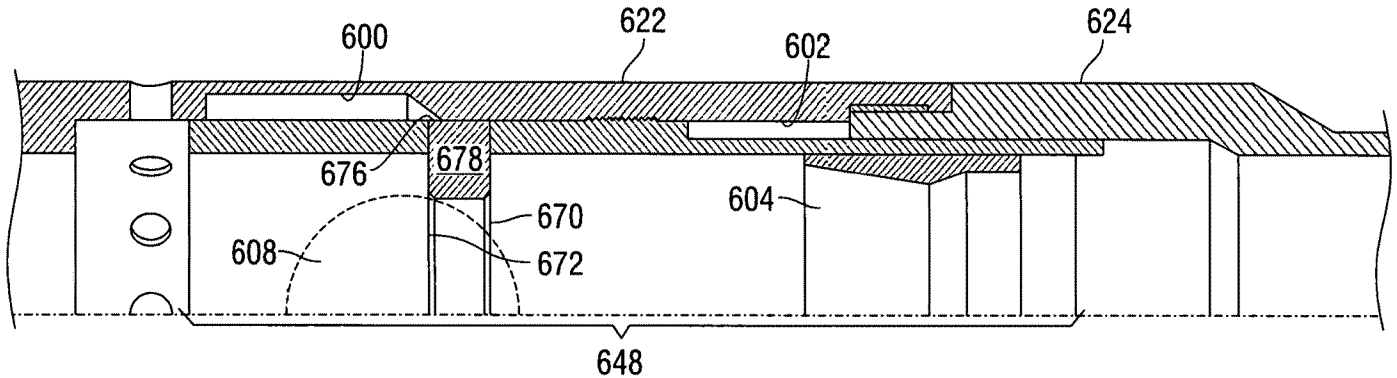

One advantage to the system illustrated in FIGS. 17A-178B is that plugs which would activate the sleeve if the C-ring 670 were compressed can pass through the treating sleeve assembly of this embodiment to activate tools further downwell. In other words, this embodiment will allow the placement of valve seats configured to utilize smaller plugs upwell of valve seats configured to use larger restrictor elements. This will increase the flexibility of systems incorporating such valve assemblies and can increase the number of valves that can be operating in a single well.

This arrangement can be continued with any number of valve assemblies in series per stage, with no limit on the number of sleeves. Moreover, this system allows for an increase in the number of stages. For example, a trio of tools using single valve seats configured for a 2.0 inch, 1.875 inch, and 1.75 inch ball respectively, can be placed in a well. A second trio of tools using double valve seats with upper valves configured for use with 2.0 inch, 1.875 inches, and 1.75 inches are then placed upwell of the first trio. The upper valve seats of this second trio of stages are C-rings in the uncompressed state (as described with referenced with respect to FIG. 17A) such that a 2.0 inch ball can pass through each upper seat without engaging the seat sufficiently to move the plug seat and its associated sleeves in a downwell direction. The lower valve seats of the second trio comprise C-ring valve seats configured to engage a 2.0 inch ball and to shift the assembly in response thereto.

In operation, a first 1.75 inch ball is placed in the well and allowed to engage and activate the 1.75 inch stage of the first trio of stages. A first 1.875 ball is placed in the well and allowed to engage and activate the 1.875 inch stage of the first trio of stages. Following the 1.875 inch ball, a first 2.0 inch ball is placed in the well. This ball first engages the lower seat of the 2.0 inch stage of the second trio of stages causing the seat to shift and moving the upper ring from an uncompressed state to a compressed state. The first 2.0 ball then engages the lower seat of the 1.875 inch stage of the second trio of stages, causing the seat to shift and moving the upper ring from an uncompressed to a compressed state. The first 2.0 inch ball then engages the lower seat of the 1.75 inch stage of second trio of stages, causing the seat to shift and moving the upper ring from an uncompressed state to a compressed state. Finally, the first 2.0 inch ball engages the 2.0 inch stage of the first trio of stages and activates the tools associated with the valve assemblies of this stage.

At this point, three stages, associated with a 1.75 inch, a 1.875 inch, and a 2.0 inch valve assembly have been activated. Further, the well now contains three additional stages that can be activated by sequentially placing a 1.75 inch ball, a 1.875 inch ball, and 2.0 inch ball into the well and allowing the balls to engage their respective seats. This means that 6 stages, each stage having the potential for multiple sleeves, can be activated through use of 3 ball sizes. Further, the embodiments are not limited to the nesting of three sizes. Further nesting is possible with the valve assemblies and method of use contemplated herein, such nesting limited only by the ability of the uncompressed ring to allow larger sized balls to pass without shifting the seat.

It is possible that the lower seat is not a solid ball seat but rather a C-ring or other expandable ball seat. In fact, any method or device for engaging the lower seat to selectively create a pressure differential thereacross and activate the sleeve by an initial shift is permissible provided that it does not prevent the treatment of any previously untreated stage.

Further, it will be appreciated that a flowback bypass system may be incorporated with embodiments of the present disclosure to facilitate the production of fluids from the treated formation around any plugs that are trapped in the tubing. One flowback bypass system may be found in U.S. patent application Ser. No. 13/694,509, entitled "Flow Bypass Device and Method", which is incorporated herein by reference in its entirety as if fully set forth herein.

Numerous other advantages also accrue from the embodiments of the present disclosure. For example, certain embodiments eliminate the need to pump down isolation devices, thus eliminating the potential for expensive remedial operations and downtime between treatments. Moreover, because the ported sleeve is not required to also serve as an isolation device and does not have to withstand the associated high pressures, a wider variety of ball materials may be used for expanding operational abilities of the system overall.

The embodiments of the present disclosure also increase system effectiveness and reduce mechanical risk, thereby increasing system reliability while lowering cost. Operators need not be concerned about impacting the shifting ball into a seat at too high of a rate or pressure, thereby causing the ball or sleeve to fail. The embodiments of the present disclosure also eliminate the risk of eroding the ball seat, which could potentially eliminate a solid pressure surface for the plug to seal against, resulting in potential system failure.

The disclosure presents apparatuses, systems, and methods described in terms of illustrative embodiments in which one or more specific apparatuses, systems and methods are described. It will be recognized that alternative embodiments of such apparatuses and systems, and alternative applications of the methods, can be used in carrying out the invention as claimed. Other aspects and advantages of the present disclosure may be obtained from a study of the illustrative embodiments and the drawings, along with the appended claims. Moreover, the recited order of the steps of the method described herein is not meant to limit the order in which those steps may be performed.

We claim:

1. An apparatus for use in a well for oil, gas or other minerals, said apparatus comprising:

a housing having an interior and an exterior, a flowpath therethrough, and at least one treating port for fluid communication between the interior and the exterior;

a flapper valve with flapper sleeve;

a treating sleeve;

a seat for creation of a pressure differential thereacross, said seat having a first position and second position;

wherein, movement of the seat from the first position to the second position moves the treating sleeve and the flapper sleeve, allowing fluid communication through the at least one port and allowing the flapper valve to close.

2. The apparatus of claim 1 wherein the treating sleeve and the flapper sleeve are connected such that movement of the seat from first position to a second position releases the treatment sleeve from the flapper sleeve.

3. The apparatus of claim 2 further comprising a locking element for retaining the treatment sleeve in a designated position when the treating sleeve is separate from the flapper sleeve.

4. The apparatus of claim 1 further comprising a connecting element holding the treating sleeve and flapper sleeve together.

5. The apparatus of claim 4 wherein the connecting element comprises an expandable ring.

6. The apparatus of claim 1 further comprising an indexing element connected to the treatment sleeve.

7. The apparatus of claim 1 wherein the seat comprises an expandable plug seat.

8. The apparatus of claim 1 further comprising a retainer element configured to prevent movement of the seat below a desired pressure differential across the seat.

9. The apparatus of claim 1 wherein the seat is a plugless seat.

10. The apparatus of claim 1 wherein the seat is selected from the group consisting of expandable plug seats, expandable or collapsible C-ring plug seats, or multi seat plug seat assemblies.

11. A method for treating a well, said well comprising at least one ported valve, said ported valve comprising;

a housing with an interior and an exterior and at least one treating port therethrough;

a flapper valve;

a slidable sleeve preventing fluid communication through said treating port and preventing closure of the flapper valve the slidable sleeve comprising a treating sleeve and a flapper sleeve;

a seat assembly in communication the slidable sleeve and with a first indexing element;

the method comprising:

applying a first pressure to a first stream of fluid in the well, said first pressure creating a first pressure differential across the seat to advance the indexing element from a first neutral position to a second neutral position;

applying a second pressure to a second stream of fluid in the well, said second pressure creating a second pressure differential across the seat to advance the indexing element from a second neutral position to an activated position, moving the slidable sleeve and separating the treating sleeve and the flapper sleeve to allow fluid communication through the at least one treating port and to close the flapper valve;

treating a region of the well with fluid flowing through the at least one treating port.

12. The method of claim 11 wherein the slidable sleeve comprises a connecting element, the separating step comprising releasing the connecting element.

13. The method of claim 12 wherein the connecting element comprises an expansion ring and the housing comprises a groove on the interior, the releasing step comprising expansion of the expansion ring into the groove.

* * * * *